US005916013A

United States Patent [19]

Naumann et al.

[11] Patent Number: 5,916,013

[45] **Date of Patent: *Jun. 29, 1999**

[54] INNER RACE GRINDING MACHINE

[75] Inventors: John O. Naumann, Watervliet; David R. Glass, Scotia, both of N.Y.

[73] Assignee: Constant Velocity Systems, Inc., Clifton Park, N.Y.

[ * ] Notice: This patent is subject to a terminal disclaimer.

[21] Appl. No.: 08/876,412

[22] Filed: Jun. 16, 1997

Related U.S. Application Data

[63] Continuation-in-part of application No. 08/755,144, Nov. 22, 1996, Pat. No. 5,681,209, which is a continuation-in-part of application No. 08/593,072, Jan. 29, 1996, Pat. No. 5,577,952.

[51] Int. Cl.[6] ..... B24B 1/00

[52] U.S. Cl. ..... 451/51; 451/52; 451/61; 451/213; 451/218; 451/5; 451/381

[58] Field of Search ..... 451/51, 61, 52, 451/213, 218, 381, 5, 47, 221, 449

[56] References Cited

U.S. PATENT DOCUMENTS

| | | | |
|---|---|---|---|
| 4,095,377 | 6/1978 | Sugita | 451/51 |
| 5,259,156 | 11/1993 | Ronen | 451/51 |
| 5,384,983 | 1/1995 | Siggelin | 451/51 |
| 5,651,720 | 7/1997 | Shinomoto et al. | 451/51 |
| 5,681,209 | 10/1997 | Naumann et al. | 451/51 |

*Primary Examiner*—Robert A. Rose
*Assistant Examiner*—George Nguyen
*Attorney, Agent, or Firm*—Howard J. Greenwald

[57] ABSTRACT

A grinding machine for grinding an inner race of a constant velocity joint, which contains a grinding wheel with a concentric peripheral surface of boron nitride, and a device for rotating the grinding wheel at a speed of at least about 5,000 revolutions per minute. The machine also has a lubricating fluid injection system for lubricating the inner race and grinding bit. The machine also contains devices for moving the inner race in the X axis, in the Z axis, and simultaneously in the X and Z axes.

11 Claims, 36 Drawing Sheets

INNER RACE GRINDING MACHINE

CROSS-REFERENCE TO RELATED PATENT APPLICATION

This application is a continuation-in-part of applicants' patent application U.S. patent application Ser. No. 08/755,144, filed Nov. 22, 1996,now U.S. Pat. No. 5,681,209 which in turn is a continuation-in-part of applicants' U.S. Ser. No. 08/593,072, filed on Jan. 29, 1996, now U.S. Pat. No. 5,577,952.

FIELD OF THE INVENTION

A machine for regrinding the inner race of a constant velocity universal joint workpiece.

BACKGROUND OF THE INVENTION

Machines for manufacturing or repairing one or more of the components of constant velocity universal joints are well known. Thus, e.g., U.S. Pat. Nos. 5,197,228 and 5,359,814 disclose a machine for regrinding such components which contains means for holding the component part, a grinding bit, a rotatable support means, a motorized grinding tool, means for adjusting the position of the motorized grinding tool in the Y axis and the Z axis, and a lubricating fluid injection system. The disclosure of each of these patents is hereby incorporated by reference into this specification.

These prior art machines are not adapted to readily and efficiently grind the inner races of constant velocity universal joints.

It is an object of this invention to provide a grinding machine which can readily and effectively grind the inner races of constant velocity universal joints.

SUMMARY OF THE INVENTION

In accordance with this invention, there is provided a grinding machine for grinding an inner race of a constant velocity joint.

The machine of this invention comprises a grinding wheel with a concentric peripheral surface which comprises boron nitride and consists essentially of a steel blank coated with cubic boron nitride. The machine also contains means for rotating the grinding wheel at a speed of at least about 5,000 revolutions per minute.

The machine also has a lubricating fluid injection system for lubricating the inner race and grinding wheel. The lubricating fluid injection system is comprised of a first coolant nozzle, a second coolant nozzle, means for directing a first flow of fluid from the first coolant nozzle to a first point on the perimeter of the grinding bit, and means for directing a second flow of fluid from the second coolant nozzle to a second point on the perimeter of the grinding wheel, wherein the first point and second point are substantially coplanar. The first flow of fluid from the first coolant nozzle impinges the grinding wheel in the same direction as the first direction of rotation of the grinding wheel. The first coolant nozzle has a volumetric flow rate which is at least about two times as great as the volumetric flow rate of the second coolant nozzle.

The machine also contains means for moving the inner race in the X axis, in the Z axis, and simultaneously in the X and Z axes. Furthermore, the machine also has means for rotating the inner race.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 44 is a side view of one preferred embodiment of an inner race grinding machine.

DESCRIPTION OF THE PREFERRED EMBODIMENTS

Figure 1:
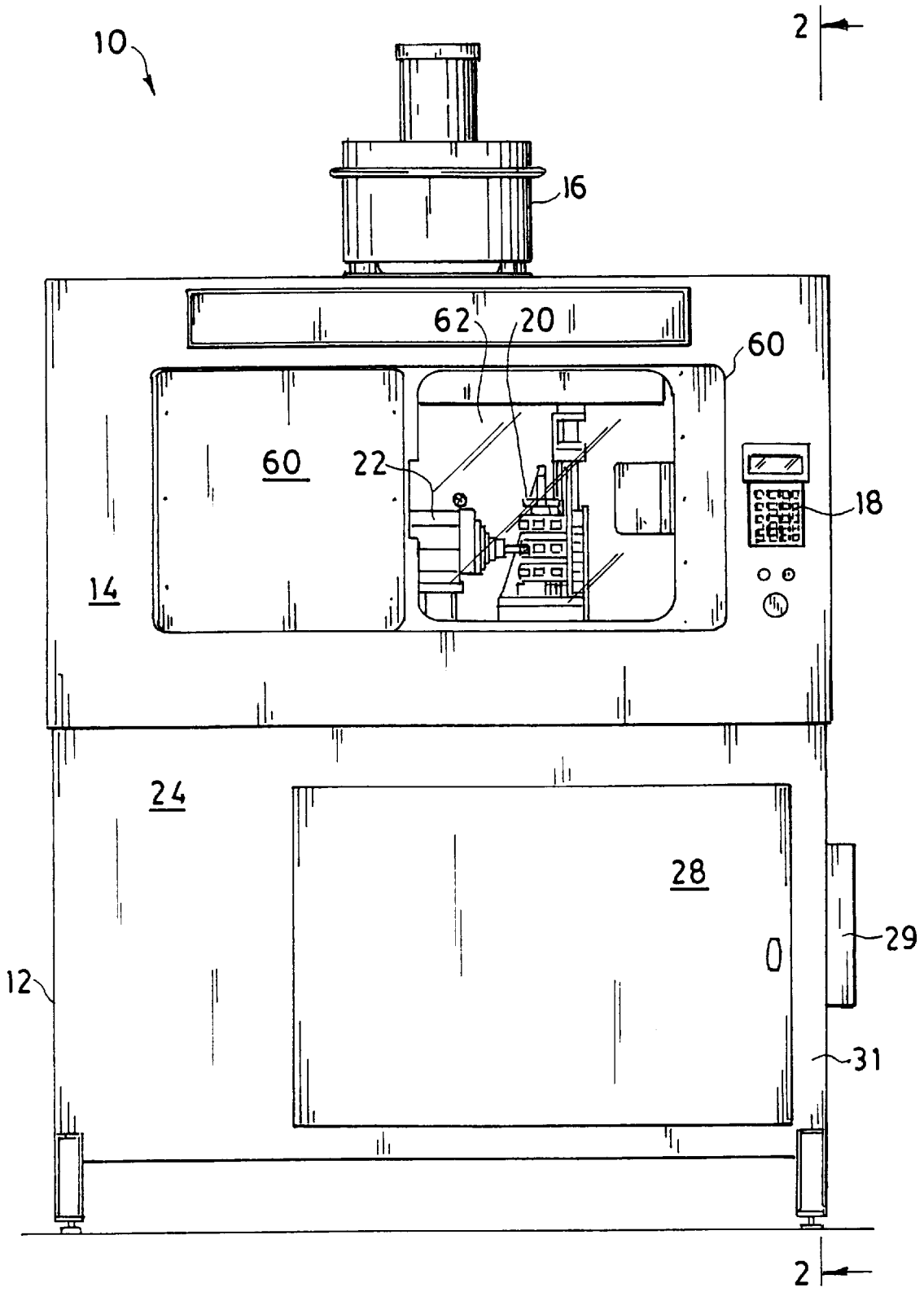
FIG. 1 is a front view of one preferred grinding machine of the invention.

FIG. 1 is a front view of multiple cage grinding machine 10. Referring to FIG. 1, it will be seen that grinding machine 10 is comprised of base assembly 12, cover 14, oil mist removal unit 16, key pad/display unit 18, multiple cage holder 20, and grinding spindle 22.

The key pad/display unit 18 is preferably connected to an indexer (not shown) which is the control unit for the stepper motors 90, 92, and 106 discussed elsewhere in this specification. Indexers are well known to those skilled in the art and are discussed, e.g., in U.S. Pat. Nos. 5,417,174, 5,409,327, 5,403,177, 5,385,003 (digital indexer), U.S. Pat. Nos. 5,245,447. 5,235,988, 5,158,168, 5,152,734, 4,770,053, 4,650,571, 4,359,677, 4,080,849, 4,053,250, 3,941,014, 3,550,534, and the like. The disclosure of each of these United States patents is hereby incorporated by reference into this specification.

With the use of known ball cages of known dimensions disposed on a cage holding fixture in known or ascertainable positions, the control unit (not shown) is capable of determining the precise location of the window openings on such cages and where and how to grind them.

Figure 6:
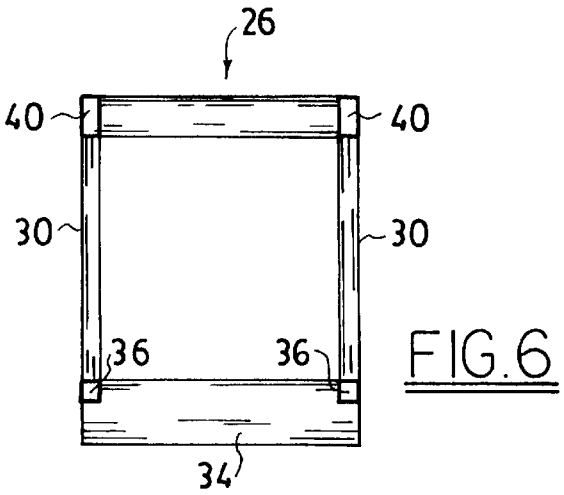
FIG. 6 is another side view of the base of FIG. 3.
Figure 4:
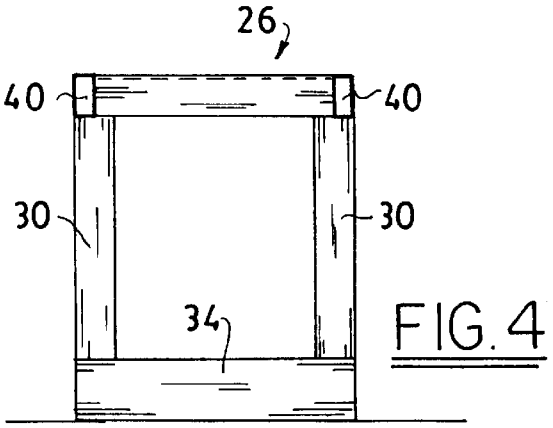
FIG. 4 is a side view of the base of FIG. 3.
Figure 5:
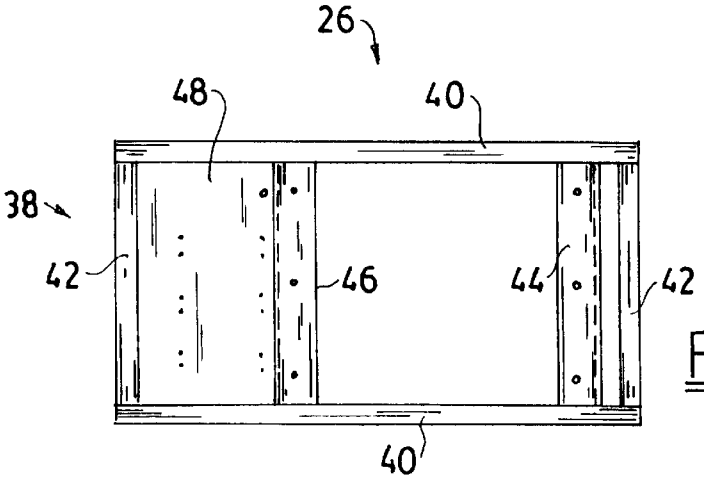
FIG. 5 is a top view of the base of FIG. 3.
Figure 3:
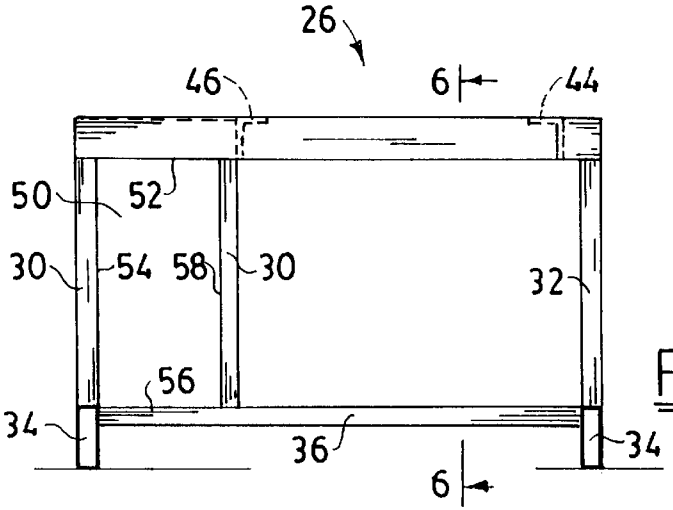
FIG. 3 is a front view of the base of the machine of FIG. 1.

Referring again to FIG. 1, and in the preferred embodiment depicted therein, it will be seen that panel 24 is removably attached to the base 26 (not shown in FIG. 1, but see FIGS. 4–6) by conventional fastening means (not shown). Hingeably attached to panel 24 is door 28.

Referring again to FIG. 1, and in the embodiment depicted, grinding machine 10 is comprised of a coolant fan inlet 29. Air is drawn through a filter (not shown) in fan inlet 29 by an fan (not shown), and the filtered air thus produced is used to cool the electrical assembly (not shown) disposed within cabinet 31.

A preferred base 26 which may be used in the grinding machine 10 is shown in more detail in FIGS. 3, 4, 5, and 6. In addition to being used in conjunction with the machine of FIG. 1, such base 26 may also be used together with the machines of FIGS. 24, 25, 34, 35, 37, and 38.

Referring to FIGS. 3, 4, 5, and 6, and in the preferred embodiment depicted therein, one embodiment of a particularly stable base 26 is illustrated. In this embodiment, it will be seen that base 26 is preferably constructed from a multiplicity of rectangular hollow steel tube members. Vertical members 30 preferably are 2"×2" steel tubing with a length of 24 inches, and vertical member 32 is 2"×4" steel tubing with a length of 24 inches. Each of vertical members 30 and 32 is supported by (and welded to) steel feet 34, which preferably are 2"×6" steel tubing with a height of 6 inches.

Disposed between, and welded to, steel feet 34 is lower longitudinal member 36, which is 2"×2" steel tubing.

Referring again to FIGS. 3–6, it will be seen that the top section 38 of base 26 is comprised of longitudinal members 40 and 42, each of which is preferably constructed from 2"×4" steel tubing. The length of members 40 is preferably about 52 inches, and the width of members 42 is preferably about 24 inches. Angle irons 44 and 46 extend from one longitudinal member 40 to the other longitudinal member 40.

Referring again to FIG. 5, a panel 48 is preferably welded in place onto the top portion 38 of base 26.

As will be apparent to those skilled in the art, the preferred base structure depicted in FIGS. 3–6 is substantially rigid and, consequently, minimizes vibration during the grinding operation. The base 26 preferably has a natural frequency of at least about 800 hertz.

As is known to those skilled in the art, the natural frequency of a structure is the frequency at which a body or system vibrates when unconstrained by external forces. See, e.g., U.S. Pat. No. 5,442,883 (natural frequency of a building), U.S. Pat. No. 5,441,256 (natural frequency of a golf club), U.S. Pat. No. 5,435,191 (natural frequency measurement system), U.S. Pat. No. 5,427,362 (natural frequency of a machine part), U.S. Pat. No. 5,421,684 (natural frequency of a bolt), U.S. Pat. No. 5,402,861 (natural frequency of an elevator car), U.S. Pat. No. 5,388,685 (natural frequency of a conveyor), U.S. Pat. No. 5,323,989 (natural frequency of a vehicle exhaust pipe), U.S. Pat. No. 5,307,508 (natural frequency of a housing), U.S. Pat. No. 5,303,681 (natural frequency of a fluid coupling), and the like. The disclosure of each of these United States patents is hereby incorporated by reference into this specification.

The load carrying capacity of base 26 is preferably at least about 400 pounds and, more preferably, is at least about 1,500 pounds. Means for determining the load carrying capacity of a structure are well known and are discussed, e.g., in U.S. Pat. No. 5,444,913 (load carrying capacity of a trussed frame), U.S. Pat. No. 5,431,475 (load carrying capacity of a dump truck body), U.S. Pat. No. 5,341,747 (load carrying capacity of a railway gondola car), U.S. Pat. Nos. 5,326,191, 5,317,846 (load carrying capacity of a concrete floor structure), U.S. Pat. No. 5,274,493 (load carrying capacity of a bearing), U.S. Pat. No. 5,110,149 (load carrying capacity of a trailer system), U.S. Pat. No. 4,704,830 (load carrying capacity of a beam), U.S. Pat. No. 3,995,438 (load carrying capacity of a hollow pile), U.S. Pat. No. 3,688,352 (load carrying capacity of a fastener), U.S. Pat. No. 3,427,773 (load carrying capacity of a beam), and the like. The disclosure of each of these United States patents is hereby incorporated by reference into this specification.

The torsional stiffness of base 26 is preferably at least about 500 foot-pounds per radian. Means for determining the torsional stiffness of a structure are well known and are discussed, e.g., in U.S. Pat. No. 5,415,610 (torsional stiffness of a machine tool frame), U.S. Pat. No. 5,415,587 (torsional stiffness of a coupling), U.S. Pat. Nos. 5,282,661, 5,275,296 (torsional stiffness of a rack), U.S. Pat. No. 5,273,301 (torsional stiffness of a bicycle fork), U.S. Pat. No. 5,246,275 (torsional stiffness of a bicycle wheel), U.S. Pat. No. 5,243,880 (torsional stiffness of a motor vehicle drive shaft), U.S. Pat. No. 5,242,267 (torsional stiffness of a torque tube), U.S. Pat. No. 5,239,886 (torsional stiffness of a servo axis drive system), and the like. The disclosure of each of these United States patents is hereby incorporated by reference into this specification.

In one preferred embodiment, the torsional stiffness is at least about 5,000 pounds per radian. In an even more preferred embodiment, the torsional stiffness is at least about 50,000 pounds per radian.

Without wishing to be bound to any particular theory, applicants believe that the unique properties of their base 26 substantially reduces the amount of "chatter" encountered during grinding As is known to those skilled in the art, chatter is the vibration of the grinding assembly caused by excitation at its natural frequency, and it often causes inaccurate grinding.

Referring again to FIG. 3, in one embodiment, not shown, a chiller (not shown) is disposed within compartment 50, which is formed by walls 52, 54, 56, and 58. This chiller (not shown) is preferably a liquid chiller which is operatively connected to spindle 22 (see FIG. 1) and preferably maintains the spindle at a temperature of less than about 80 degrees Fahrenheit.

In one embodiment, not shown, one or more of the chambers within hollow structural members 30, 32, 34, 36, 40, and 42 may be filled with vibration reducing material.

The vibration reducing material used may be, .e.g, sand, concrete, and the like. In one embodiment, the vibration reducing material has a vibration loss coefficient of less than 0.01. U.S. Pat. Nos. 5,421,574 and 5,314,180 (the disclosures of which are hereby incorporated by reference into this specification) disclose such a material, which comprises epoxy resin, polyamide resin, and a filler. such as, e.g., sand, concrete, and the like.

Referring again to FIG. 1, it will be seen that, in the embodiment depicted, grinding machine 10 is preferably comprised of oil mist removal unit 16. As will be apparent to those skilled in the art, the function of oil mist removal unit is to remove oil mist created during high-speed grinding process; and it preferably can remove at least about 95 percent of the oil mist in an air sample flowing through it at a rate of at least 250 cubic feet per minute.

One may use any of the oil mist removal devices known to those skilled in the art as oil mist removal unit 16. Thus, by way of illustration and not limitation, one may use a "Filtermist" device which is sold by Royal Products (of 210 Oser Avenue, Hauppauge, N.Y.) as model number 275 CFM (catalog number 28035).

Referring again to FIG. 1, it will be seen that removable cover 14 is comprised of an opening 60 within which is disposed a sliding glass door assembly 62. In the embodiment depicted in FIG. 1, cover 14 is not mechanically attached to sliding glass door assembly 62 and, thus, can be readily removed from the base 24. Because cover 14 is preferably attached to base 12 by conventional fasteners (such as screws), it can readily be detached from base 12 to obtain more ready access to the innards of the machine 10.

Figure 2:
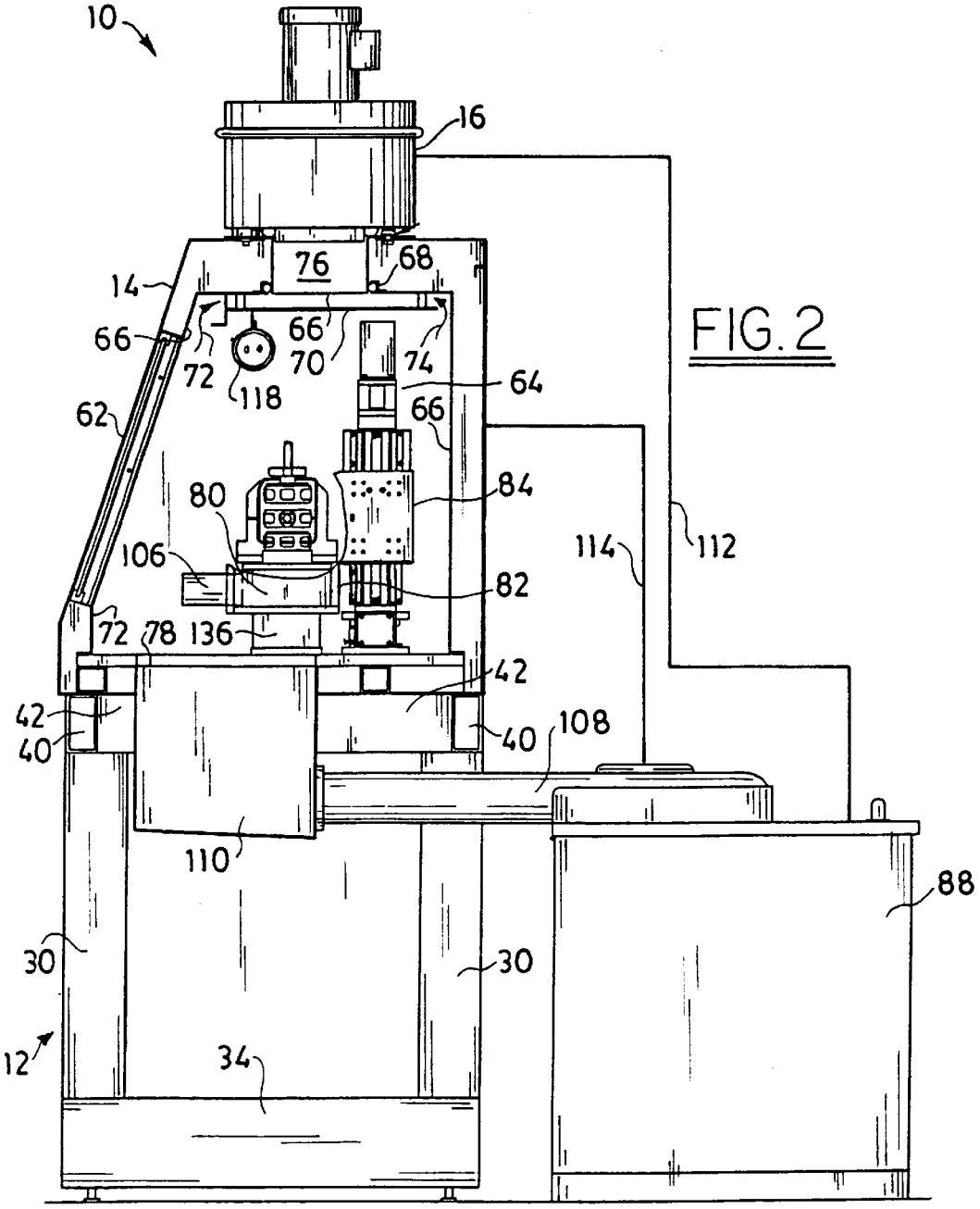
FIG. 2 is a side view of the grinding machine of FIG. 1.

FIG. 2 is side view of the grinding machine 10 of FIG. 1 with the exterior panels (such as panel 24) removed to better illustrate the structure of the device 10.

Referring to FIG. 2, it will be seen that cover 14 sits upon base members 40 and 42 and is attached to such base members 40 and 42 by conventional fasteners, such as screws (not shown). Upon removal of these fasteners, cover 14 can readily be removed to furnish access to the grinding cabinet 64 of machine 10 (see FIG. 7).

In one embodiment, depicted in FIG. 2, grinding cabinet 64 is formed by sheet metal panels 66 welded together. The sliding glass door assembly 62 may be attached to the grinding cabinet 64 by conventional means such as, e.g., screws, silicone sealant, etc.

Referring again to FIG. 2, it will be seen that oil mist removal unit 16 is connected to grinding cabinet 64 by means of flexible seal 68. Air flows in the direction of arrows 72 and 74 around baffle 70 and thence through orifice 76 into air mist removal unit 16.

Referring again to FIG. 2, grinding cabinet 64 is attached to base plate 78 by conventional means, such as screws, bolts, silicone sealant, and the like.

Rotary table 80 is mounted on bracket 82 which, in turn, is mounted on X,Z slide 84.

One may use any conventional means for moving bracket 82 in the X and Z axes. Thus, referring to FIG. 10, and in the embodiment depicted therein, it will be seen that slide 84 is comprised of stepper motors 90 and 92. As will be apparent to those skilled in the art, stepper motor 90 moves bracket 82 in the direction of arrows 94 and 96 by means of a ball screw (not shown) on slide 98. Stepper motor 92 moves bracket 82 in the direction of arrows 100 and 102 by means of a ball screw (not shown) on slide 104.

Referring again to FIG. 10, rotary table assembly 80 is comprised of a stepper motor (not shown) which is operatively connected to bracket 82 and rotates it in either a clockwise or a counterclockwise direction.

Figure 14:
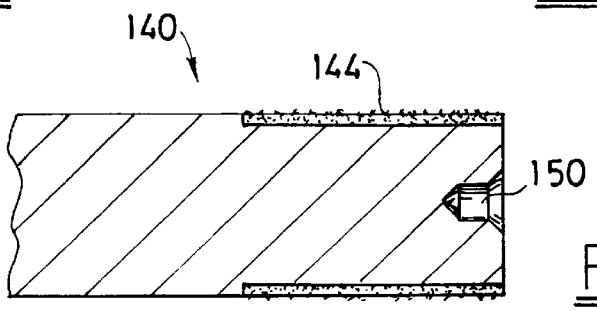
FIG. 14 is an enlarged sectional view of a portion of the grinding bit of FIG. 12.

By way of further illustration, slide assembly 84 is also illustrated in FIG. 14.

Referring to FIG. 2, it will be seen that machine 10 is comprised of coolant delivery system 88 which is comprised of a pump (not shown), oil inlet line 114, oil return line 108, and oil catch basin 110. Oil caught in catch basin 110 is returned to coolant delivery system 88 via line 108, filtered by conventional means in such coolant delivery system 88, and returned via a pump (not shown) via oil delivery line 114 to machine 10.

Referring again to FIG. 2, the oil mist captured in oil mist separator unit 16 is separated from air and other fluid in separator 16 by conventional means. Thus, e.g., one may effect such separation by centrifugation.

The oil mist thus separated is then returned to the coolant delivery system tank 88 via oil mist return line 112.

Figure 7:
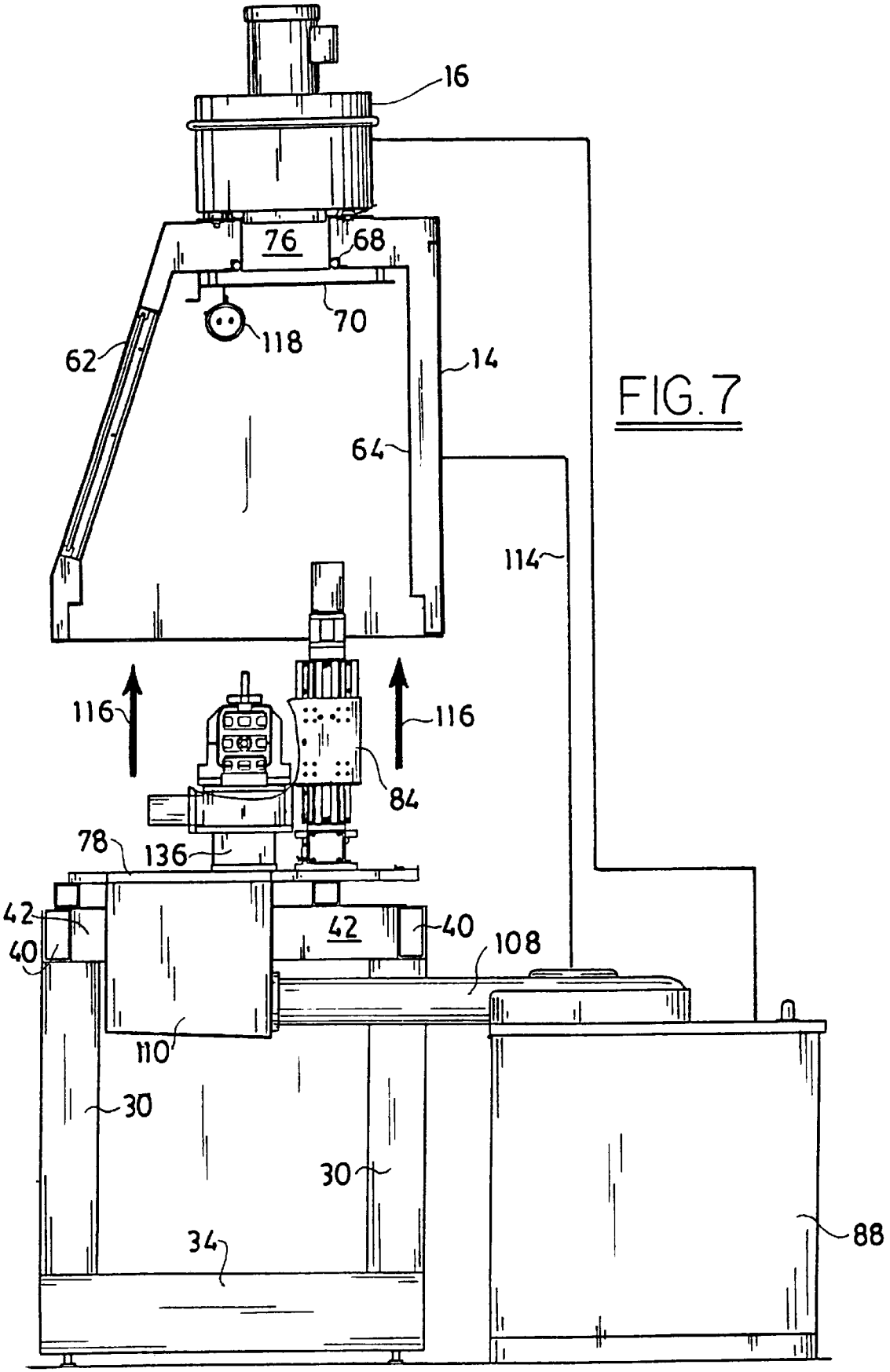
FIG. 7 is an exploded view of the machine of FIG. 1.

Referring to FIG. 7, and in preferred embodiment depicted therein, it will be seen that cover 14, grinding cabinet 64, and sliding glass door assembly 62 can be readily removed from base plate 78 by removing any fasteners and/or seals securing said units (not shown) and lifting the unit in the direction of arrows 116.

Referring again to FIG. 7, it will be seen that a fluorescent light fixture 118 is preferably disposed within grinding cabinet 64.

Figure 8:
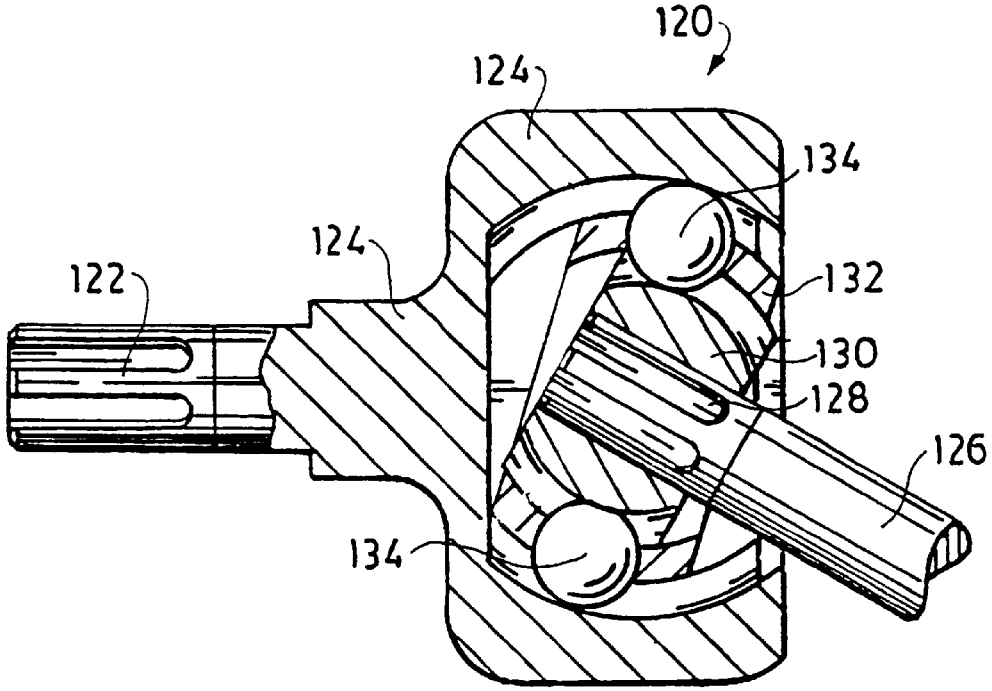
FIG. 8 is a sectional view of a universal constant velocity joint.
Figure 9:
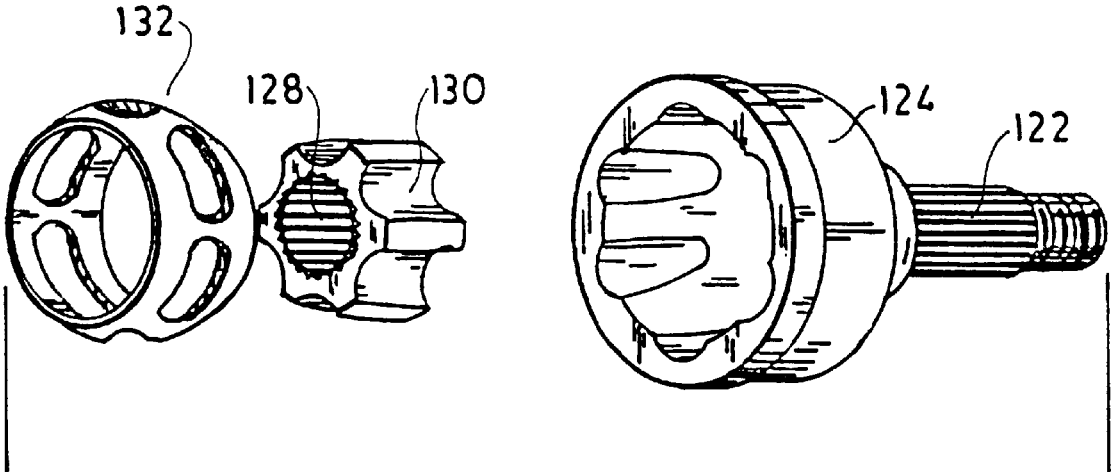
FIG. 9 is an exploded, perspective view of the universal constant velocity joint of FIG. 8.

FIG. 8 is a sectional view of a typical constant velocity universal joint 120 which is comprised of outer race spline 122, outer race body 124, cut off axle shaft 126, inner race splines 128, inner race 130, cage 132, and bearing balls 134. FIG. 9 is an exploded view of some of these components, further illustrating how they are generally disposed vis-a-vis each other.

Referring again to FIG. 10, it will be seen that spindle 22 is preferably fixed in place by means of its attachment to pedestal 136 by means of spindle mount 138.

Pedestal 136 is preferably attached to base plate 78 by means of conventional fasteners, such as screws, bolts, etc. In one preferred embodiment, pedestal 136 and spindle mount 138 consist essentially of aluminum. Without wishing to be bound to any particular theory, applicants' believe that the use of aluminum for these elements minimizes differences in coefficients of thermal expansion between the spindle mount 138, the pedestal 136, and the slide assembly 84 (which also is preferably made from aluminum).

In one embodiment, not shown, spindle pedestal 136 is preferably a hollow structure. In another embodiment, not shown, spindle pedestal 136 is filled with a vibration reducing material such as, e.g., sand or concrete.

Spindle mount 138 preferably is attached to spindle pedestal 136 by conventional means.

Spindle 22 is preferably adapted to rotate at a speed of at least about 25,000 revolutions per minute and, more preferably at a speed of from about 30,000 to about 50,000 revolutions per minute. These high speed spindles are well known in the art and are discussed, e.g., in U.S. Pat. Nos. 5,322,494, 5,145,298, 4,979,853, 4,867,619, 4,681,492, 4,519,734, 4,148,246, 4,131,054, 3,567,975, and the like. The disclosure of each of these United States patents is hereby incorporated by reference into this specification.

The spindle 22 rotates grinding bit 140, which rotates while being maintained in substantially the same vertical and horizontal position. The grinding bit 140 contacts cages 132 (shown in dotted line form in FIG. 10) when they are moved into the appropriate positions vis-a-vis grinding bit 140. Cages 132 are preferably mounted in a multiple cage holding device (see element 160 or element 161 of FIG. 17 or FIG. 18); and the multiple cage holding device is preferably moved so that the grinding bit 140 is disposed in the appropriate positions within the windows of cages 132.

Figure 19:
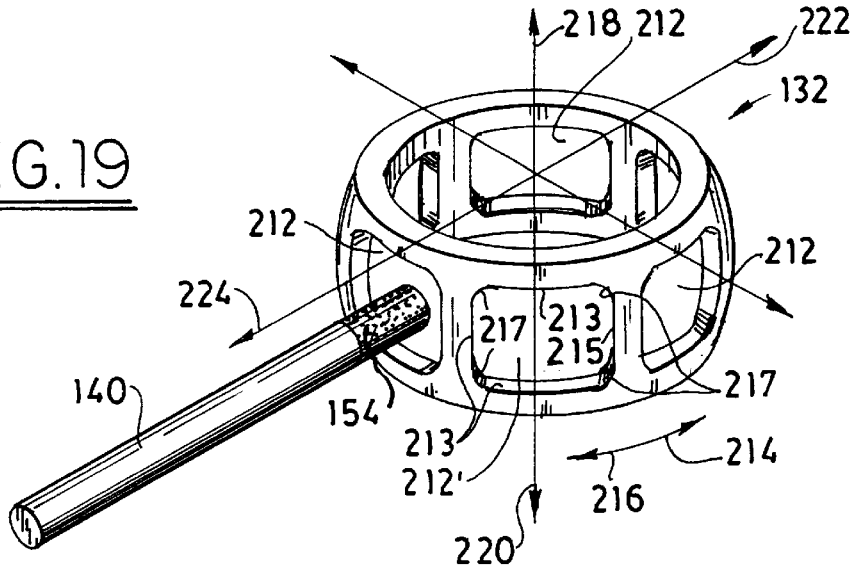
FIG. 19 is a perspective view of the grinding bit of FIG. 12, showing how such a grinding bit is typically disposed within the window of a ball cage.

As is known to those skilled in the art, and referring to FIG. 19, the ball cages in constant velocity universal joints generally contain six windows 212, each of which are substantially congruent with each other. The term congruent, as used in this specification, means that the windows have substantially the same size and shape. Thus, referring again to FIG. 19, it will be seen that each of congruent windows 212 has a substantially rectangular shape with parallel substantially linear walls 213 and parallel substantially linear walls 215. The cage windows 212 may, but need not, contain arcuate corner portions 217.

The cage windows 212 must be disposed vis-a-vis grinding bit 140 so that the grinding bit 140 is capable of grinding the appropriate surfaces of each of the windows. In the process of this invention, this is accomplished by disposing a multiplicity of cages in fixed, stacked relationship to each other and to specified reference points so that the congruent windows on one stacked cage are vertically aligned with the congruent windows on a vertically adjacent stacked cage, and so that the distance of the congruent cages in any particular stacked cage can readily be determined by reference to specified reference points.

In a preferred process of this invention, at least two cages are mounted upon a cage holding fixture 160 or 161. These cages generally have the same size and shape, and the windows in each of the cages are substantially congruent with each other.

The process of this invention is designed to align the congruent windows of one cage with the congruent windows of another cage. Furthermore, because the height 141 of different ball cages 132 varies (see FIG. 21), the process of this invention is adapted to mount the cages on a holder at specified reference points to compensate for such variances in height. The distance between any stacked cage 132 in cage holder 160 and the center of any of the windows in such cage can readily be determined by the process of this invention even if variations in the heights of vertically adjacent stacked cages 132 exist.

Figure 10:
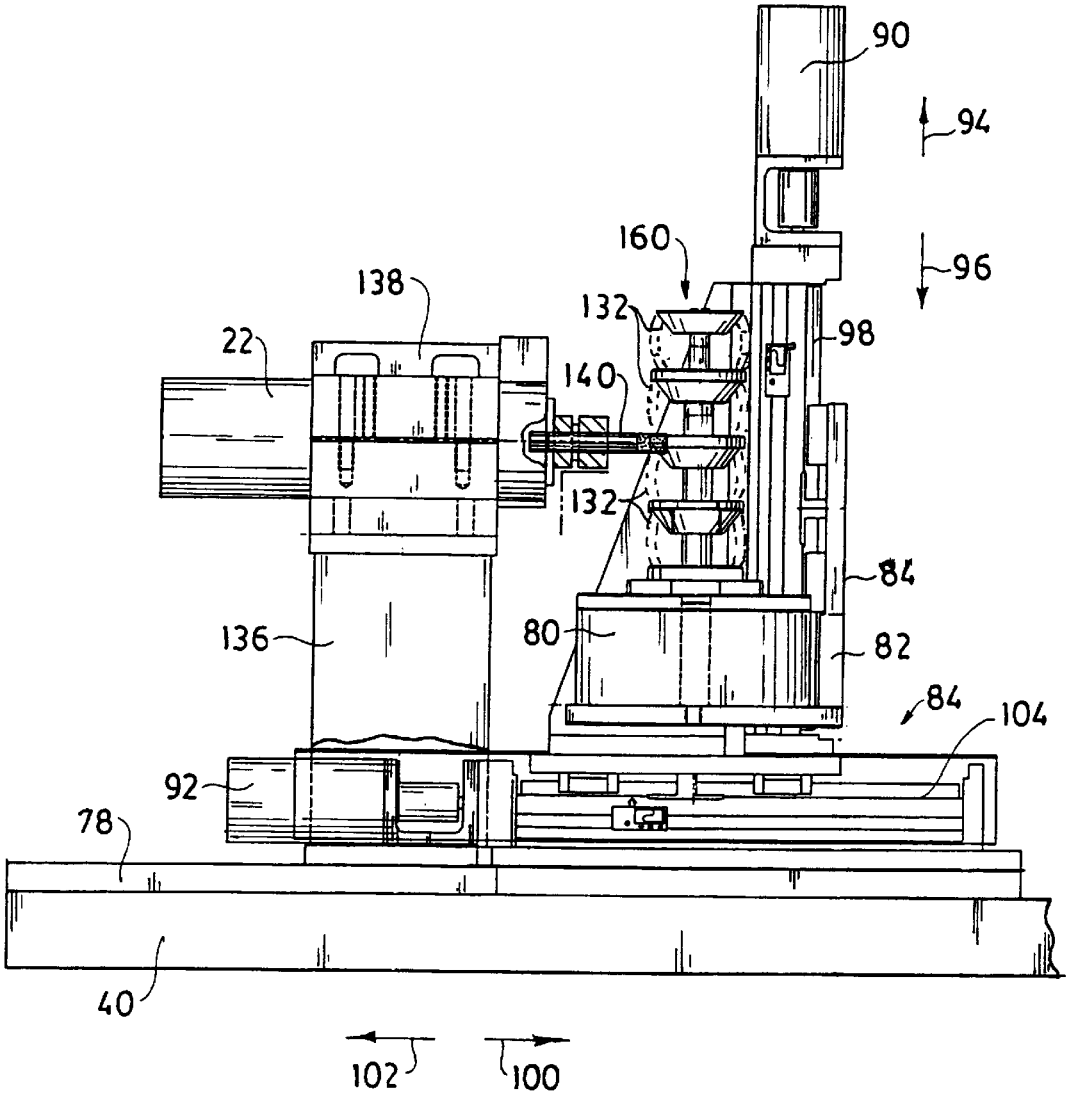
FIG. 10 is a front view of the machine of FIG. 1 shown with its multiple cage holding fixture in place.
Figure 11:
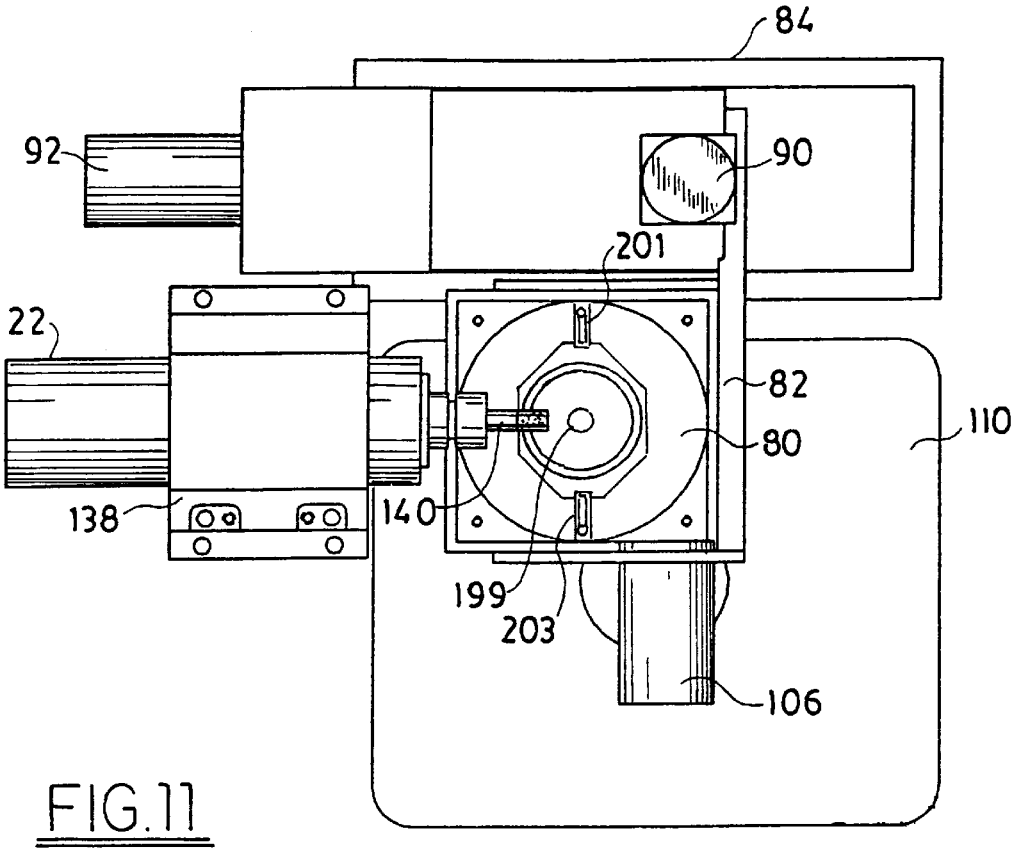
FIG. 11 is partial top view of the grinding machine of FIG. 1.

FIG. 11 is a top view of the machine of FIG. 10. in which means for attaching a multiple cage holder of this invention to the machine are illustrated. These attachment means will be discussed later in this specification.

Figure 12:
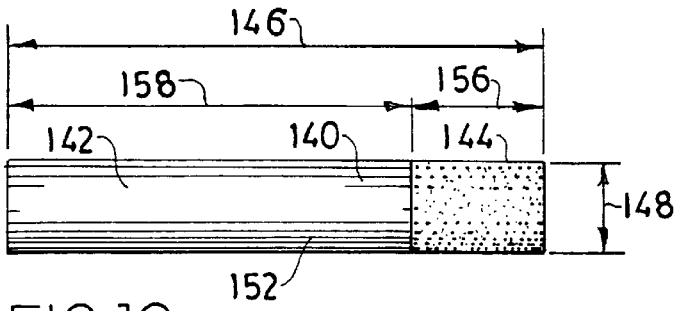
FIG. 12 is a side view of the grinding bit used in the grinding machine of FIG. 1.
Figure 13:
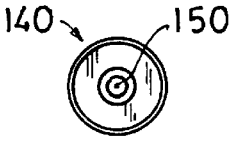
FIG. 13 is a front view of the grinding bit of FIG. 12.

FIG. 12 is a side view of a preferred grinding bit 140. Referring to FIG. 12, it will be seen that grinding bit 140 is a substantially integral structure which consists of a base 142 of high tensile steel and a tip 144 which is plated with an abrasive such as cubic boron nitride.

It is preferred that base 142 consist essentially of high tensile strength alloy steel with a tensile strength of from about 60,000 to about 150,000 pounds per square inch, a yield strength from about 40,000 to about 120,000 pounds per square inch, and a hardness (Rockwell C) of from about 20 to about 40.

Grinding bit 140 preferably has a length 146 of at least about 2.75 inches and, more preferably, from about 2.75 to about 5.0 inches. The grinding bit 140 preferably has a diameter 148 of from about 0.25 to about 1.0 inches and, more preferably, from about 0.3 to about 0.6 inches.

In one embodiment, illustrated in FIG. 14, grinding bit 140 is comprised of a mark 150, which often is left by a machining center.

Referring again to FIG. 12, it will be seen that grinding bit 140 is comprised of an unplated section 152 and a plated section 144. The length 156 of the plated section 144 is preferably from about 0.25 to about 1.5 inches and also preferably is at least about 40 percent of the length 158 of the unplated section 152.

It is preferred that the coating on plated section 144 consist essentially of cubic boron nitride. In one embodiment, a single crystal layer of cubic boron nitride is electroplated onto said steel substrate. In another embodiment, a single crystal layer of cubic boron nitride is brazed onto the steel substrate.

Figure 15:
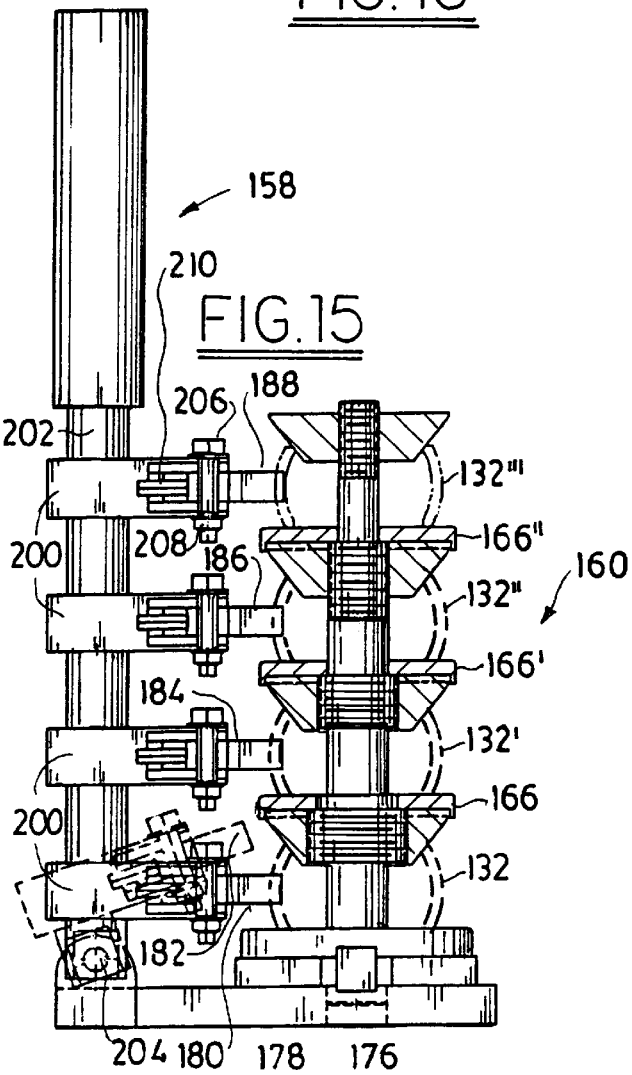
FIG. 15 is a front view of a preferred alignment tool used in the system of the invention, illustrating such alignment tool being used in conjunction with the multiple cage holding fixture.

FIG. 15 is a front view of one preferred embodiment of an alignment tool adapted to align cages 132 disposed within cage holder fixture 160.

Figure 17:
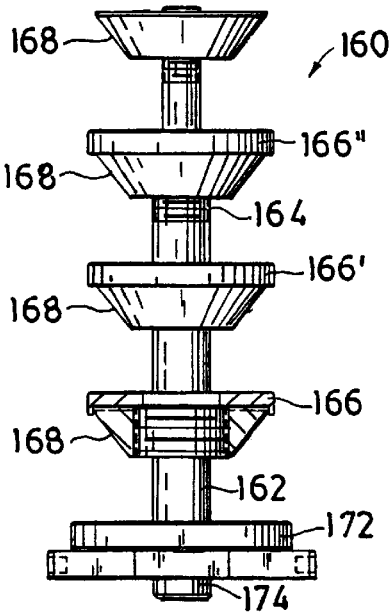
FIG. 17 is a front view of one preferred multiple cage holder of this invention.

In the embodiment depicted in FIGS. 15 and 17, multiple cage holder fixture 160 is adapted to hold four cages 132. In the embodiment depicted in FIGS. 18, multiple cage holder fixture 161 is adapted to hold three cages 132. As will be apparent to those skilled in the art, cage holder fixture 160/161 may be utilized with as few as one cage and as many as about six cages. It is preferred that from about 2 to about 4 cages 132 be used with cage fixture 160 or cage fixture 161.

Referring to FIGS. 17 ad 18, it will be seen that multiple cage holding fixtures 160 and 161 are each preferably comprised of a shaft 162 comprised of threaded portions 164 on its exterior surface. Fixedly mounted on shaft 162 are datum plates 166, 166', and 166".

In the embodiment depicted in FIG. 17, the distance between base 172 and datum plate 166 is a fixed, known quantity, as is the distance between datum plate 166 and datum plate 166', and as is the distance between datum plate 166' and 166"; in one aspect of this embodiment, each of these distances is equal. Because the grinding machine knows what these distances are, regardless of height of the cage 132 mounted on the fixture 160, it also knows that a specified distance from either base 172, or datum plate 166, or datum plate 166', it will find a window on the stacked cage.

Figure 18:
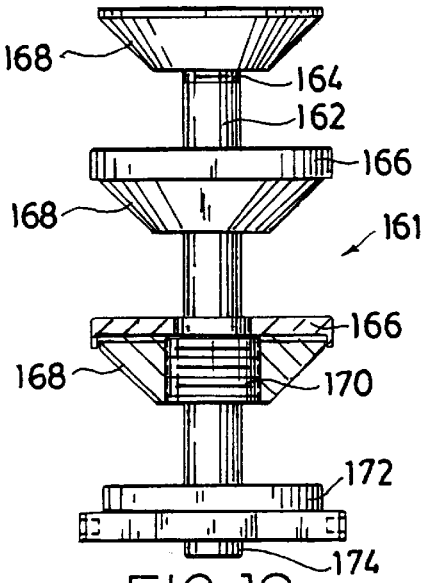
FIG. 18 is a front view of another preferred multiple cage holder of this invention.

Referring to FIG. 18, it will be seen that also mounted on shaft 162 are clamping cones 168 which, preferably, have a substantially conical shape. Each of such movable clamps 168 preferably contain internal threads 170 which are adapted to mate with external threads 164 on shaft 162 at specified portions of said shaft. As will be apparent, as the clamp is rotated in a clockwise or a counterclockwise manner, its position vis-a-vis the nearest datum plate 166 will vary.

Figure 17A:
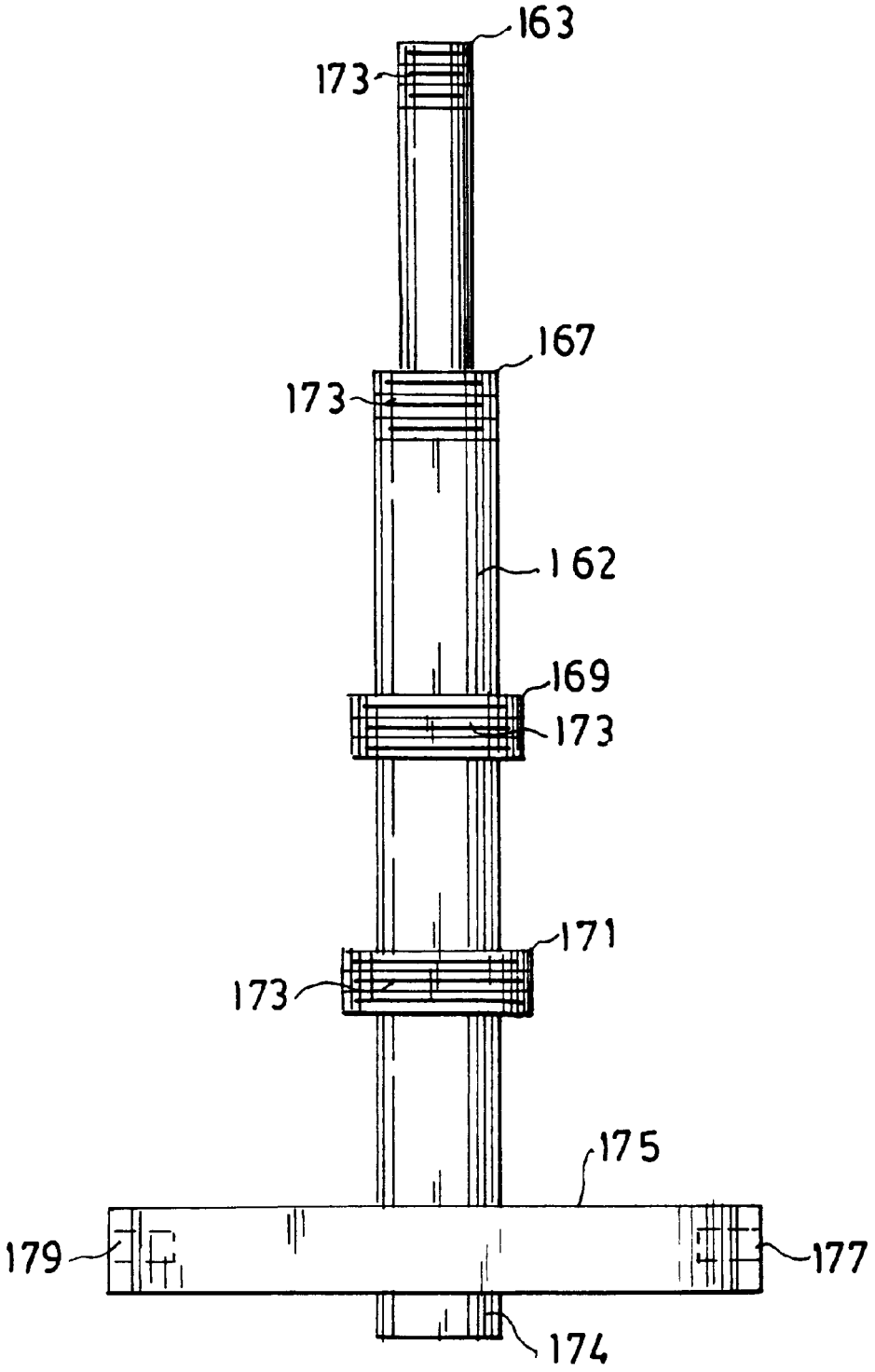
FIG. 17A is a front view of the shaft of the multiple cage holder of FIG. 17.

FIG. 17A is a front view of a preferred embodiment of shaft 162 which differs in structure from the shaft 162 depicted in FIGS. 15, 17, and 18. Referring to FIG. 17A, it will be seen that shaft 162 is preferably an integral structure preferably made of hardened steel. Shaft 162 preferably has a substantially conical shape and increases in diameter from its top 163 to its bottom 165.

Disposed along the length of shaft 162 are several annular ledges 167, 169, and 171 which, as will be discussed hereafter, are used to support datum plates 166. Since the distance of these annular ledges 167, 169, and 171 from base 175 is known, the distance from base 175 of datum plates of known thickness also is known.

Figure 17B:
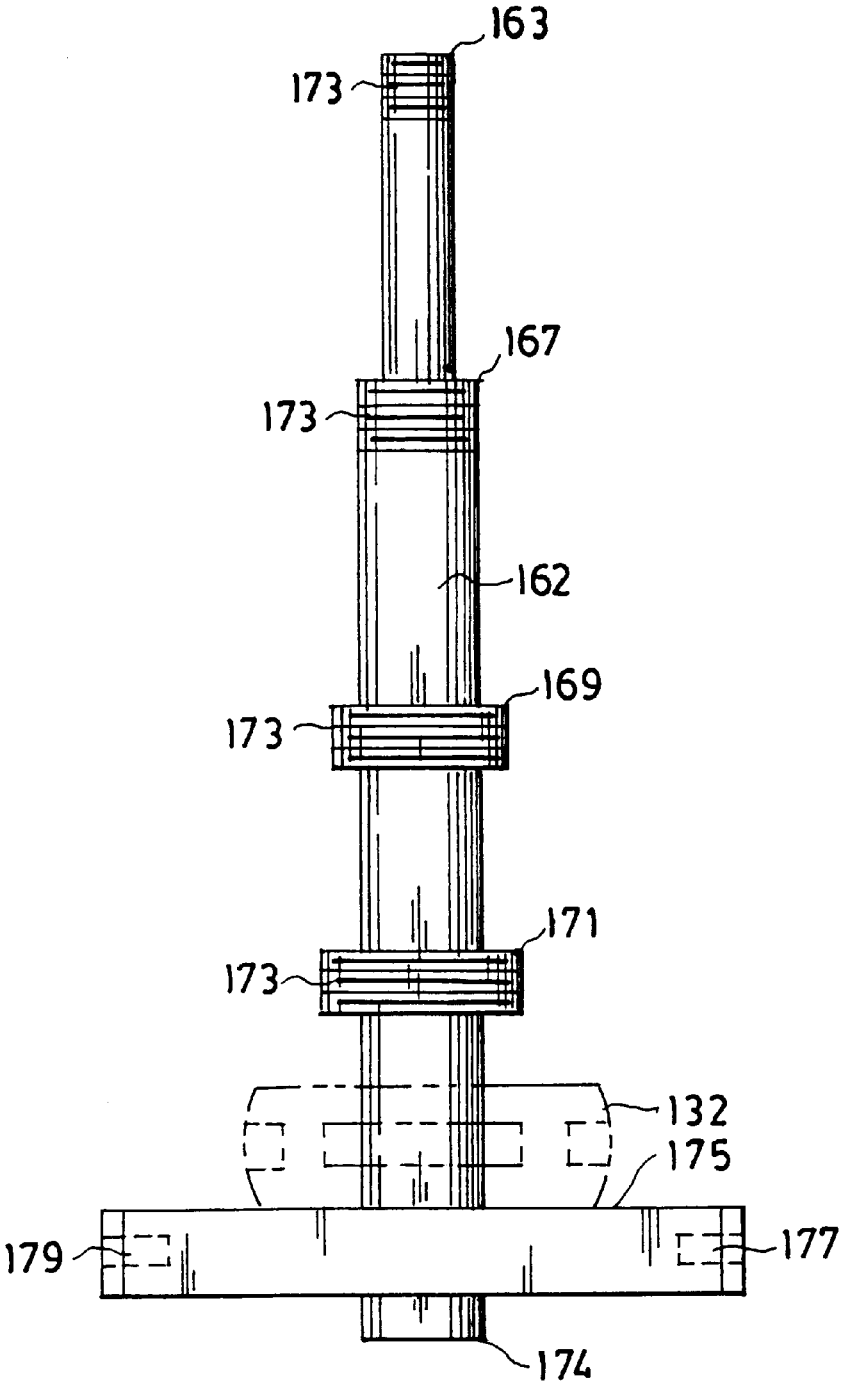
FIG. 17B is a front view of the shaft of FIG. 17A with a first ball cage loaded onto it.

Shaft 162 is also comprised of base 175, which is used to support the first cage 132 loaded onto the shaft (see FIG. 17B).

Referring again to FIG. 17A, top 163 of shaft 162 is comprised of external threads 173. External threads 173 are also disposed beneath each of ledges 167, 169, and 171.

Referring again to FIG. 17A, shaft 162 also is comprised of a base 175 comprised of recesses 177 and 179. Recesses 177 and 179 are adapted to engage with, and be disengaged from, spring-loaded plungers discussed later in this specification (see, e.g., FIG. 11).

Figure 17C:
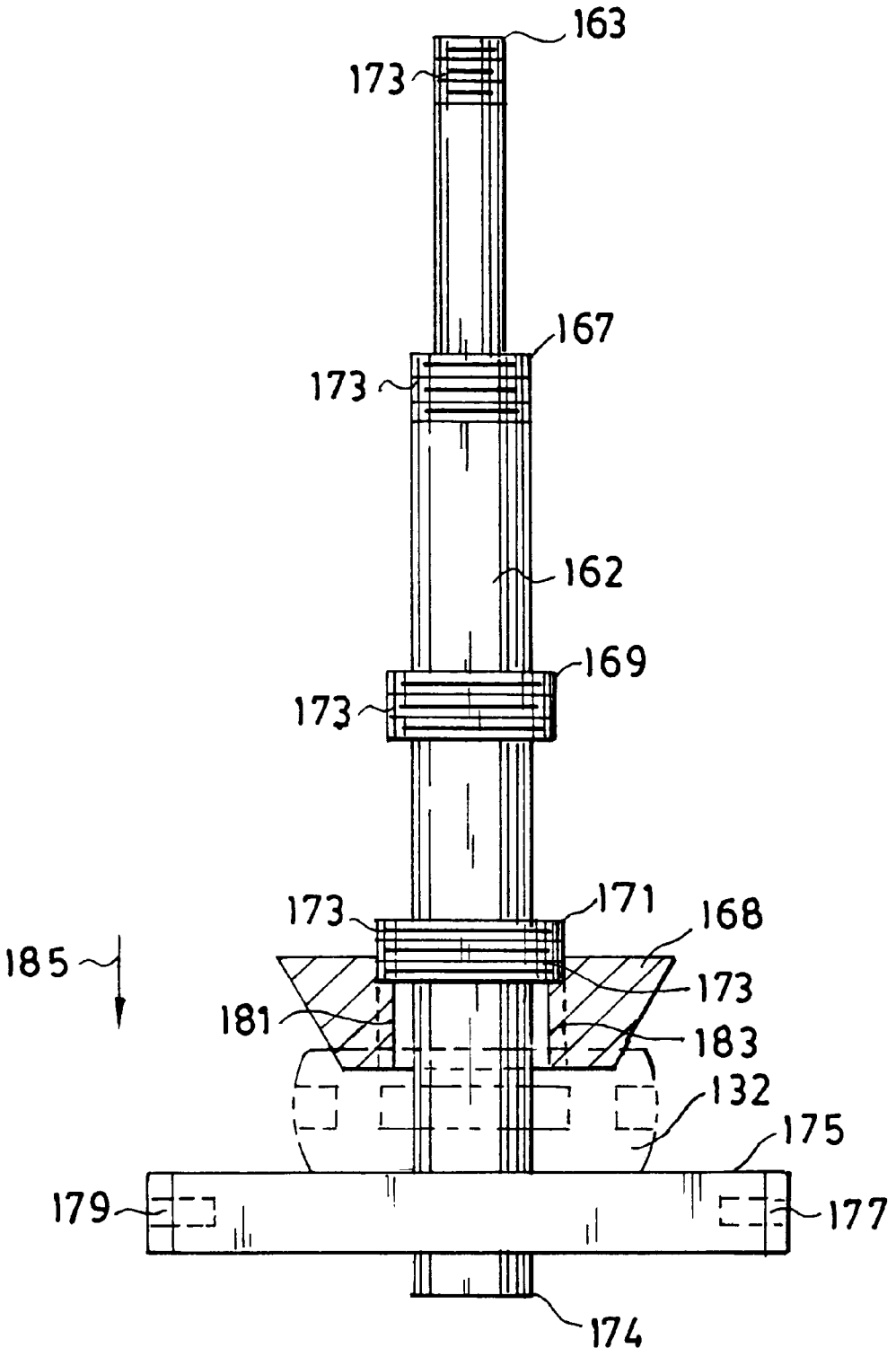
FIG. 17C is a front view of the shaft of FIG. 17B with a conical clamp disposed so that it is contiguous with the first ball cage of FIG. 17B.

Referring to FIG. 17B, and in the first step of the process of this invention, cage 132 is positioned until it is contiguous with base 175. Thereafter, as is illustrated in FIG. 17C, clamping cone 168 is disposed on shaft 162 until its internal threads 181 and 183 are contiguous with external threads 173 of shaft 162. Rotation of clamping cone 168 in a clockwise direction moves it downwardly in the direction of arrow 185 and thus presses against, centers, and secures cage 132.

Figure 17D:
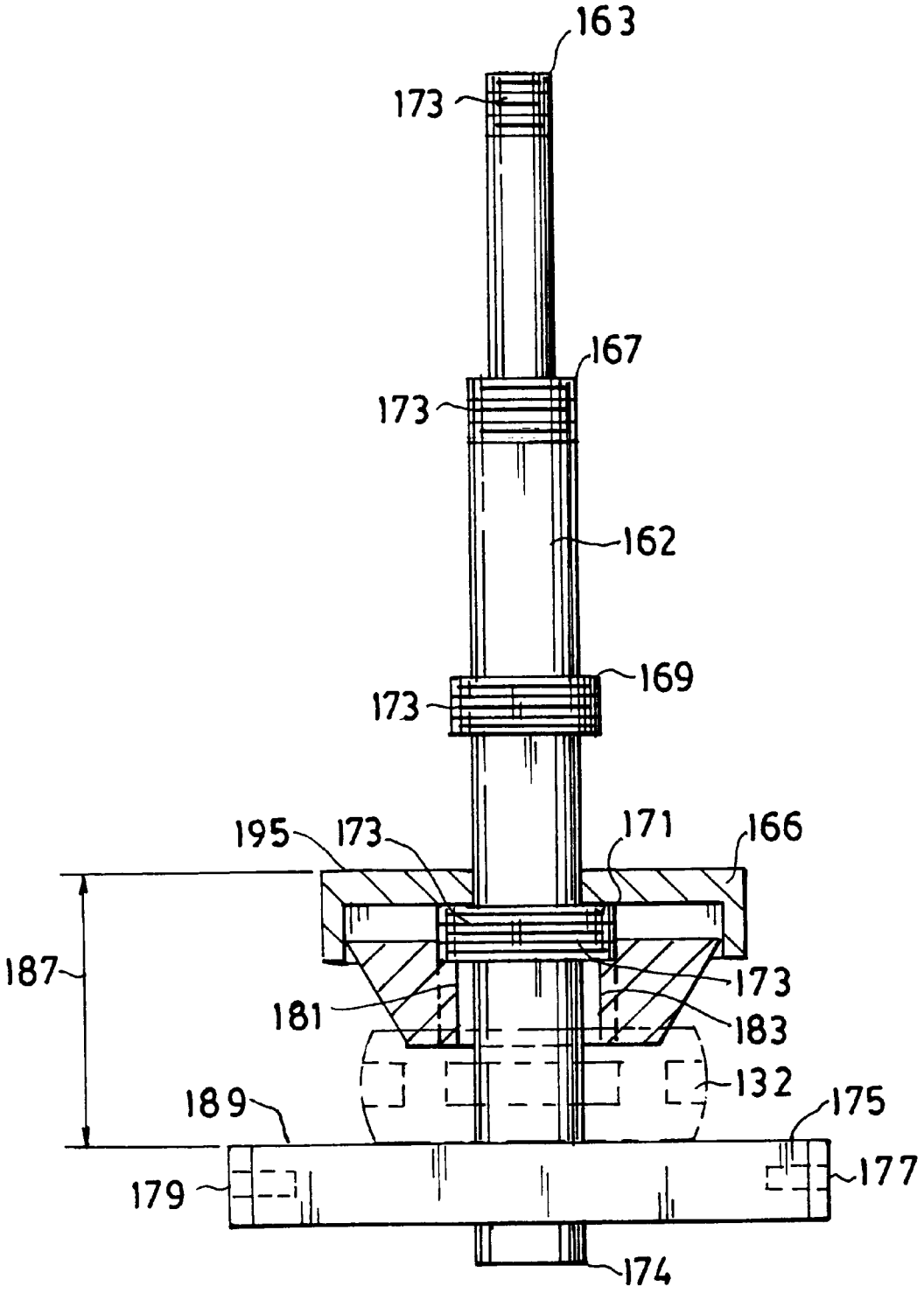
FIG. 17D is a front view of the shaft of FIG. 17C with a datum plate disposed so that it is contiguous with the first conical clamp of FIG. 17C.

In the next step of the process, illustrated in FIG. 17D, a datum plate 166 is then disposed on shaft 162 until it is contiguous with and rests on the ledge 171. This datum plate 166 can now serve the same function for cage 132' (see FIG. 17E) as does base 175 serve for cage 132; both can be used as fixed reference points.

Figure 17E:
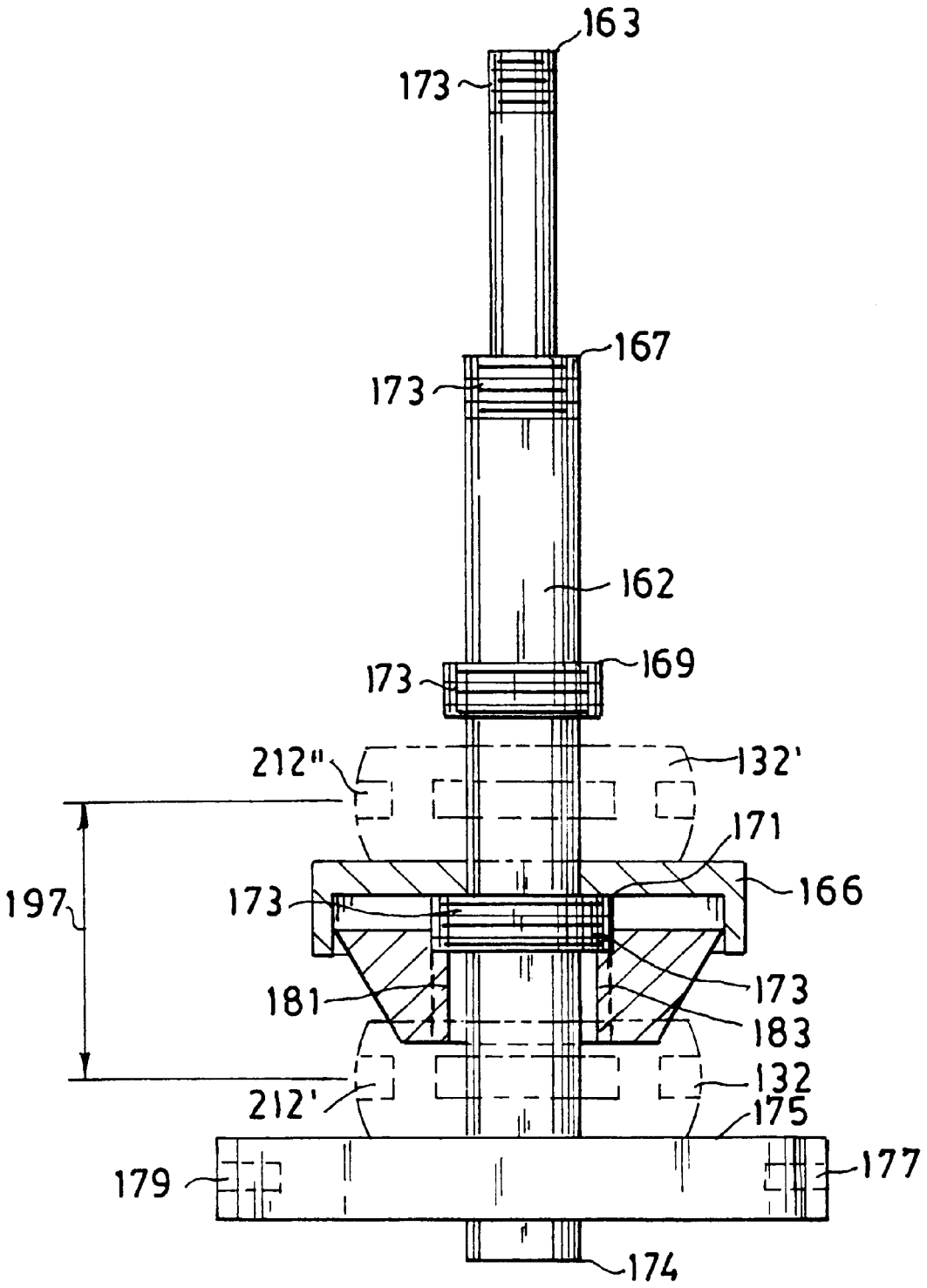
FIG. 17E is a front view of the shaft of FIG. 17D with a second ball cage disposed so that it is contiguous with the datum plate of FIG. 17D.

In the next step of the process, illustrated in FIG. 17E, cage 132' is now disposed on shaft 162 until it is contiguous with datum plate 166. As will be apparent to those skilled the art, because the system knows the location of the ledges 167, 169, and 171 as well as the location of the datum plates 166, it also knows the distance between the distance between the centers of windows 212' and 212" of adjacent cages. With this knowledge, and with the knowledge of the distance between the centers of the windows in all other stacked adjacent cages, it can move the cage holding mixture 160 or 161 with precision to grind such stacked windows accurately in spite of possible variations in the height of such cages 132.

Referring again to FIGS. 15, 16, 17, and 18, the fixtures 160 and 161 are preferably configured by first sliding the first cage to be mounted down the shaft until it impacts base 172. Because the clamps are configured so that they get bigger fro top to bottom, the first cage can readily be pushed towards base 172.

Once the first cage has been disposed between base 172 and the next adjacent clamp 168, the fixture 160 and/or 161 may be mounted on alignment tool 158. Section 174 of shaft 162 is preferably disposed within orifice 176 of base 178 of alignment tool 158 while finger 180 is in raised position 182.

Figure 16:
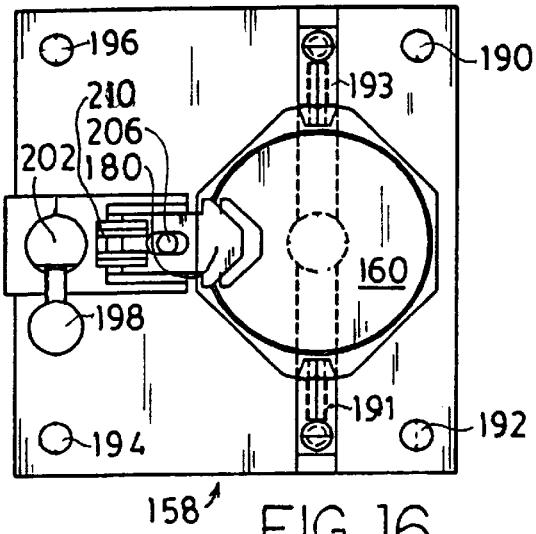
FIG. 16 is a top view of a preferred alignment tool depicted in FIG. 15.

In one embodiment, illustrated in FIG. 16, the cage fixture 160 or 161 containing one or more cages disposed on it has its portion 174 of shaft 162 disposed within orifice 176. Thereafter cage fixture 160 or 161 is rotated in a counterclockwise direction from about 15 to about 45 degrees until spring loaded alignment fingers 191 and 193 (see FIG. 16) mate with recesses (not shown) in the base of fixture 160 or 161, thereby locking said fixture into place; a similar structure is illustrated in FIG. 11.

Once the radial alignment of the windows of a particular cage has been effected by the manner described, the multiple cage holding fixture 160 or 161 can be unlocked by pressing down on it while rotating it counterclockwise. Thereafter, when the fixture 160 or 161 has been fully loaded, it may be removably attached to the rotary table 80 (see FIG. 11).

Referring again to FIGS. 15–18, and in the alignment process, the cage is rotated to allow alignment finger 180 to become disposed within a cage window, thereby aligning it such window; and the cage is then tightened in place by rotating the adjacent movable clamp 168 clockwise to lock the first cage into place. Thereafter, alignment finger 180 is then raised, the multiple cage holding fixture 160 or 161 is then removed from the alignment tool 158, a second cage 132' is then disposed on top of the next adjacent datum plate 166', the assembly is then mounted again in alignment tool 158, the finger 184 is then disposed within the window of cage 132' to align it, the adjacent movable clamp 168' is then turned clockwise to fix the cage in place, and the process is then repeated for the third cage 132".

As will be apparent to those skilled in the art, because fingers 180, 184, 186, and 188 are vertically aligned with each other, the cages 132, 132', 132", and 132'" aligned with alignment tool 158 will each have their cage windows vertically aligned.

FIG. 16 is a top view of alignment device 158. Base 178 of this device contains orifices 190, 192, 194, and 196 which can be used, together with conventional fasteners, to fixedly attach alignment tool 158 to any work table.

Referring again to FIG. 16, it will be seen that device 158 preferably is comprised of at least one thumb screw 198 which allows one to removably attach each alignment body 200 on specified positions on arm 202 which correspond to the heights of the cages 132 on cage apparatus 160 or 161.

Referring again to FIG. 16, it will be seen that arm 202 is swingably attached to base 178 by means of pivot pin 204, thereby allowing the fingers 180, 184, 186, and 188 to be moved away from or towards the windows on the cages 132 mounted on fixture 160 or 162.

Referring again to FIG. 15, it is preferred to attach fingers 180, 184, 186, and 188 to bodies 200 by means of a bolt 206 and nut 298, although other fasteners may also be used. It is preferred that each of such fingers 180, 184, 186, and 188-188 be spring-loaded.

As will be apparent to those skilled in the art, the use of applicants' device allows one not only to align the adjacent cages 132 so that the distances between the centers of their windows are known, but is also allows one to align such windows with each other in vertical orientation.

The cage holding fixture 160 and/or 161 with the cages aligned in it may be attached to (or detached from) the rotary table 80 (see FIG. 11) in substantially the same manner as it is attached to (or detached from) alignment tool 158. Thus, referring to FIG. 11, the loaded cage holding fixture 160 or 161 containing one or more cages disposed on it has its portion 174 of shaft 162 (see FIGS. 17 and 18) disposed within orifice 199. Thereafter cage fixture 160 or 161 is rotated clockwise from about 15 to about 45 degrees until spring loaded alignment fingers 201 and 203 mate with recesses 177 and 179 in the base of 175 fixture 160 or 161 (see FIGS. 17A to 17F), thereby locking said fixture into place. To disengage the cage holding fixture 160 or 161 from the rotary table 80, it may be turned counterclockwise to disengage spring loaded fingers 201 and 203.

FIG. 19 illustrates grinding bit 140 disposed within a window 212; in this embodiment, the center of each window 212 is preferably located about 60 degrees away from the center of each adjacent window; and the windows 212 are substantially symmetrically disposed around the perimeter of cage 132.

The grinding bit 140 rotates, but it is fixed in the X, Y, and Z axis. The cage may be moved in the direction of arrows 214, 216, 218, 220, 222, and/or 224 to change the position of the cage and its window 212 vis-a-vis grinding bit 140.

The relative position of tool bit 140 can be changed in the left or right direction by rotating cage 132 which, in turn, is effected by rotating the cage fixture 160/161 attached to rotary table 80 a specified number of degrees, depending on the length of the cage windows 212 and 212'. By comparison, the relative position of tool bit 140 may be changed in the up or down position by moving in the cage fixture 160/161 in the Z axis of the XZ slide 84. When it is desired to remove the grinding bit 140 from window 212, this may be effected by moving the XZ slide 84 in the X axis.

Figure 20:
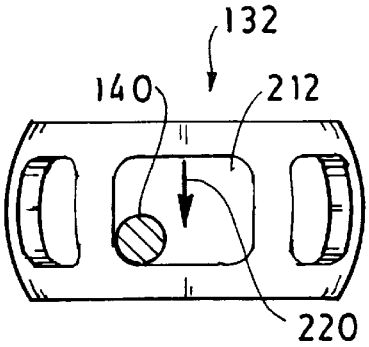
FIGS. 20, 21, 22, and 23 illustrate the cage of FIG. 19 with the grinding bit of FIG. 19 being disposed within it in various positions.
Figure 21:
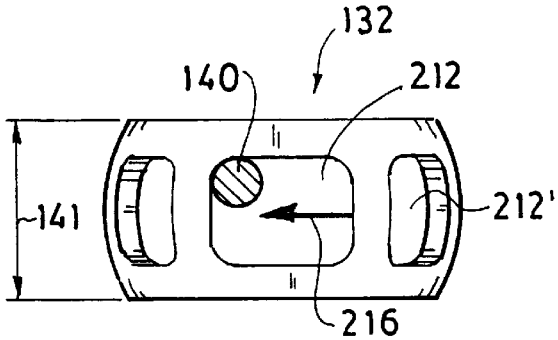

By way of illustration, when grinding bit 140 is in the position depicted in FIG. 20, the multiple cage fixture 160 or 161 (not shown) in which the cage is mounted may be moved in the direction of arrow 220 until the grinding bit is in the position depicted in FIG. 21.

Figure 22:
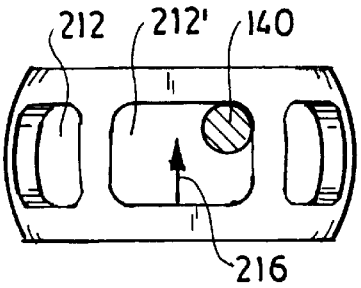

By way of further illustration, when the grinding bit 140 is in the position depicted in FIG. 21, the multiple cage holder 160 or 161 (not shown) on which the cage 132 is mounted can be moved in the direction of arrow 224 to remove the grinding bit 140 from window 212, the multiple cage holder 160 or 161 (not shown) can then be rotated counterclockwise the appropriate number of degrees in the direction of arrow 216, and the grinding bit 140 can be inserted into window 212' to assume the position depicted in FIG. 22 by moving the multiple cage holder 160 or 161 (not shown) in the direction of arrow 222.

Figure 23:
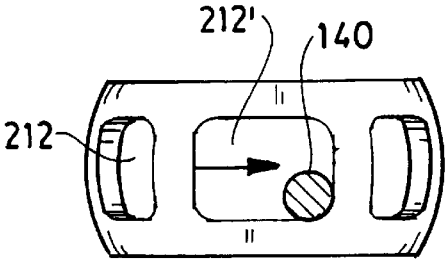

By way of yet further illustration, when the grinding bit is in the position depicted in FIG. 22, it may be moved to the position depicted in FIG. 23 by moving the multiple cage holder 160 or 161 (not shown) in the direction of arrow 216.

Figure 24:
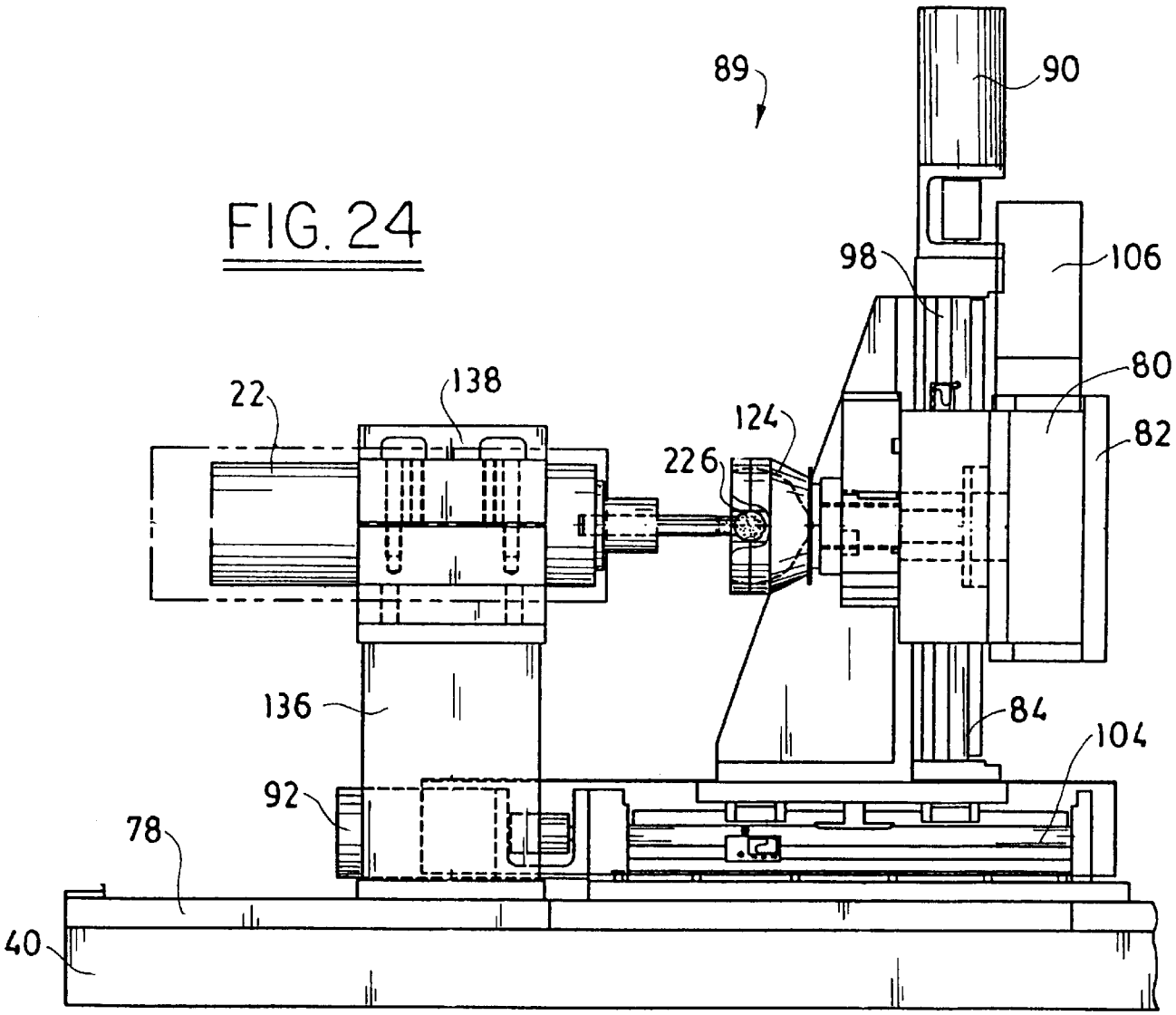
FIG. 24 is a front view of a portion of another preferred grinding machine of this invention.

FIG. 24 is front view of a grinding machine 89 utilizing substantially all of the elements of the grinding machine depicted in FIGS. 1–23 but with these components arranged in a different configuration. In the machine 89 of FIG. 24, the rotary table 80 is mounted vertically to the XZ slide 84 rather than horizontally, and a different grinding tip 226 is used.

Figure 25:
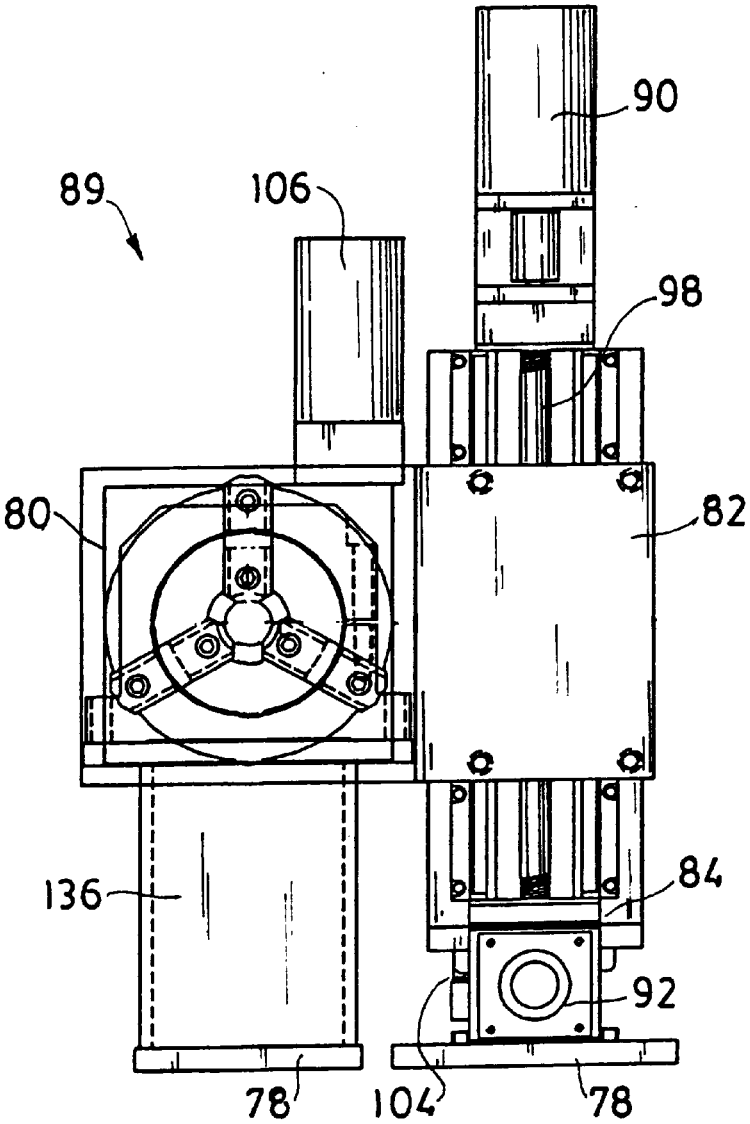
FIG. 25 is a side view of the grinding machine of FIG. 24.

FIG. 25 is a side view of the grinding machine 89 of FIG. 24.

Figure 26:
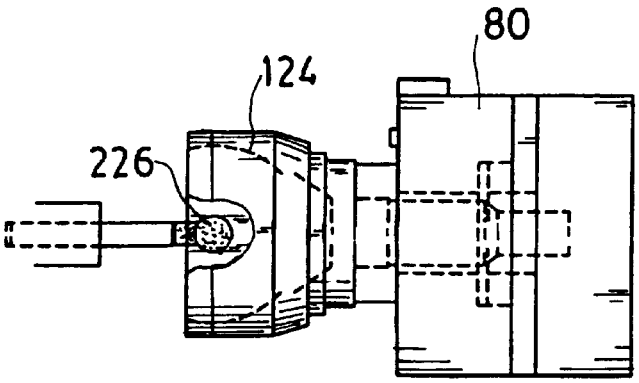
FIG. 26 is a sectional view of a portion of the machine of FIG. 24.

FIG. 26 is a partial top view of FIG. 24, illustrating tool tip 226 grinding one track of housing 124. Referring to FIG. 26, it will be seen that housing 124 is attached to rotary table 80.

Figure 27:
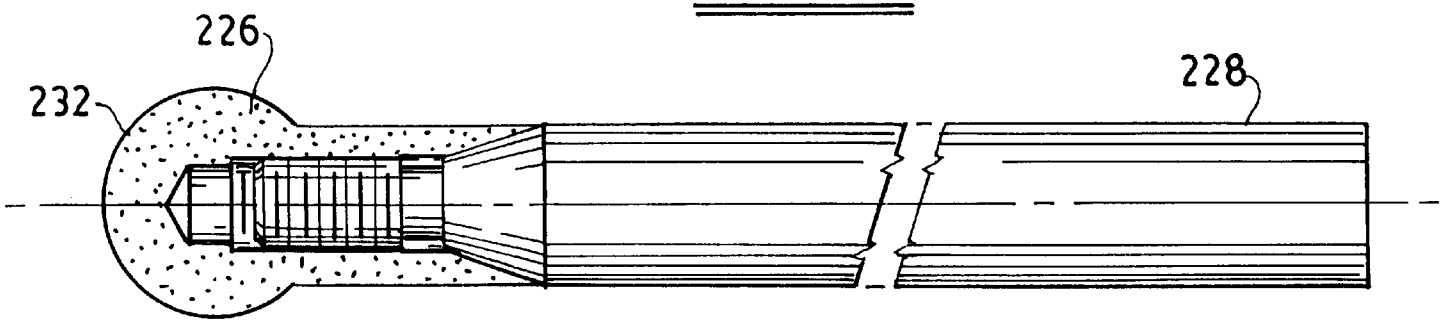
FIG. 27 is a side view of the grinding bit assembly used in the machine of FIG. 24.
Figure 28:
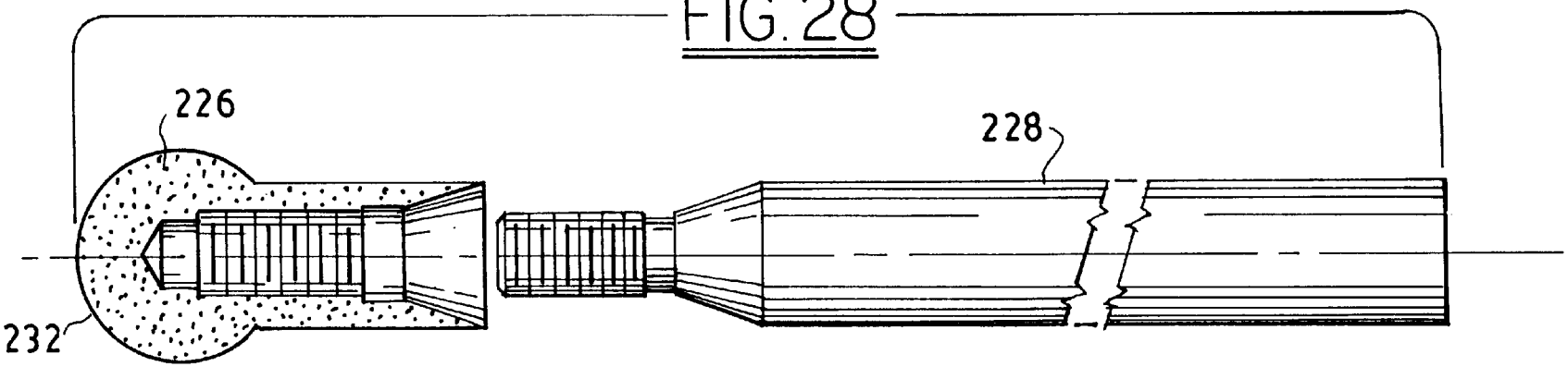
FIG. 28 is an exploded view of the grinding bit assembly of FIG. 24.

FIGS. 27 and 28 illustrate a grinding bit which can be used to grind the housing 124 (not shown). The grinding bit is comprised of an arbor 228 which, preferably, consists essentially of carbide material. The grinding bit is also comprised of grinding tip 226 which is coated with cubic boron nitride material 232.

Referring to FIGS. 27 and 28, it is preferred that the front of the grinding plated portion 232 of grinding tip 226 be substantially spherical.

Figure 29:
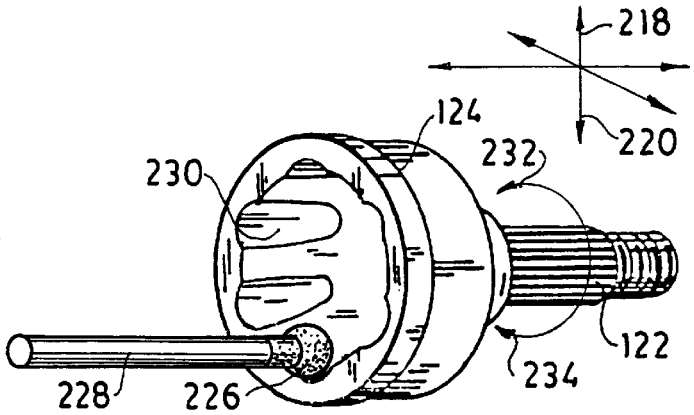
FIG. 29 is a partial perspective view of the machine of FIG. 24, illustrating a universal joint housing being ground.

FIG. 29 illustrates how plated portion 232 of the grinding tip is disposed vis-a-vis the tracks 230 of housing 124. As will be apparent to those skilled i the art, the rotary table 80 (not shown) which holds such housing 124 may be moved in the X axis and/or the Z axis to separate the housing 124 from the tool bit 228. Thereafter, the housing 124 may be rotated by the rotary table 90 in the direction of arrow 232 or 234, and the housing 124 may then be moved in the X axis and/or the Z axis to reposition the tool bit 128 in another track 230.

Figure 30:
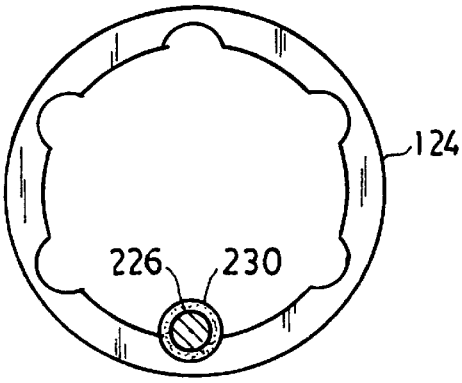
FIG. 30 is front view of the machine of FIG. 29.
Figure 31:
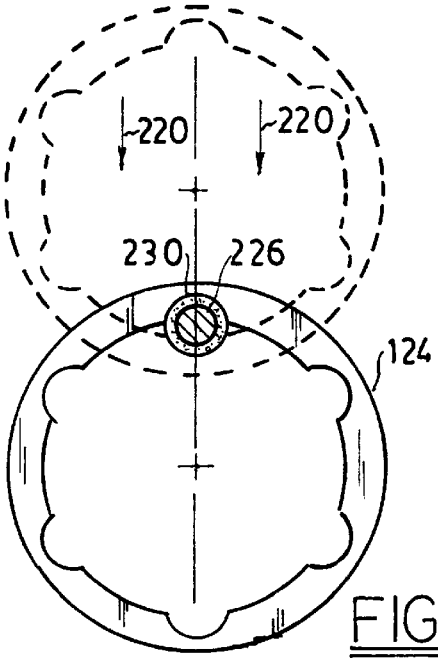
FIG. 31 is a schematic view illustrating the grinding of a universal joint housing.
Figure 32:
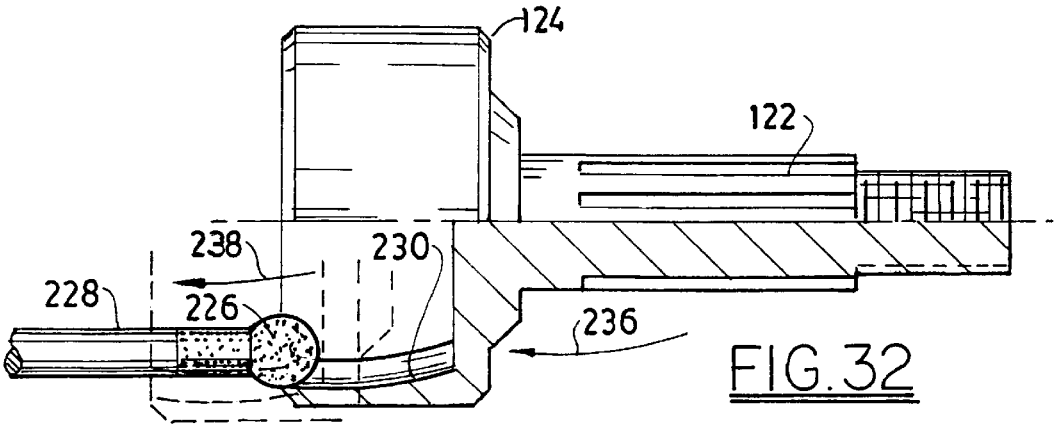
FIG. 32 is a schematic view of the grinding assembly of FIG. 29.

FIG. 32 shows that housing 124 can be made to move in a substantially arcuate path (see arrows 236 and 238) by simultaneously coordinating motion in the X and Y axis. As will be apparent to those skilled in the art, many other motions can be created by such simultaneous coordination. Thus, tool bit 226 attached to arbor 22 can be caused to grind a substantially arcuately shaped track 230 in housing 124 (see FIGS. 29 and 30).

Figure 33:
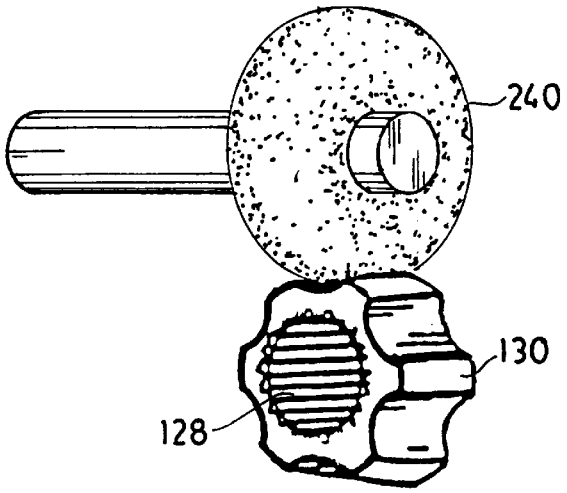
FIG. 33 is a perspective view of a grinding wheel assembly.

FIG. 33 shows an inner race 130 of a constant velocity universal joint (not shown) being ground by a grinding wheel assembly 240.

Figure 34:
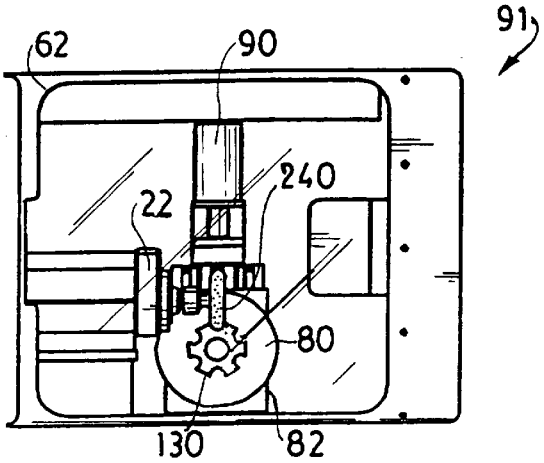
FIG. 34 is a front view of a preferred grinding machine utilizing the grinding wheel assembly of FIG. 33.
Figure 35:
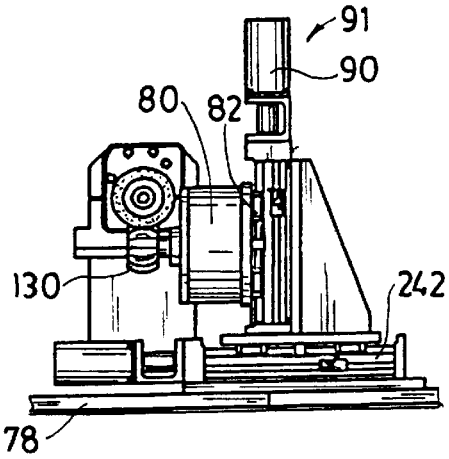
FIG. 35 is side view of the machine of FIG. 34.

FIG. 34 is a front view of an grinding machine 91 utilizing the grinding assembly of FIG. 33. FIG. 35 is a side view of the grinding machine 91 of FIG. 34 in which a sliding glass door assembly 62 has been omitted for the purposes of illustration. Referring to FIG. 35, a YZ slide 242 is used in place of the XZ slide 84 in the embodiment depicted.

Figure 36:
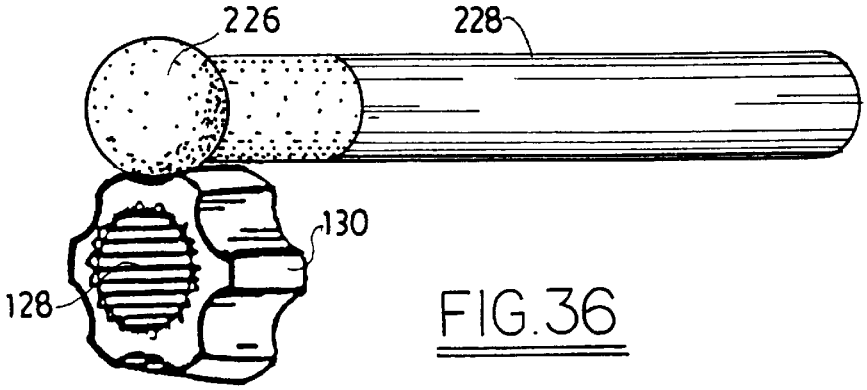
FIG. 36 is a perspective view of another preferred grinding bit.

FIG. 36 is a perspective view of grinding bit comprised of grinding tip 226 attached to arbor 228. In the embodiment depicted, the grinding bit is grinding inner race 130.

Figure 37:
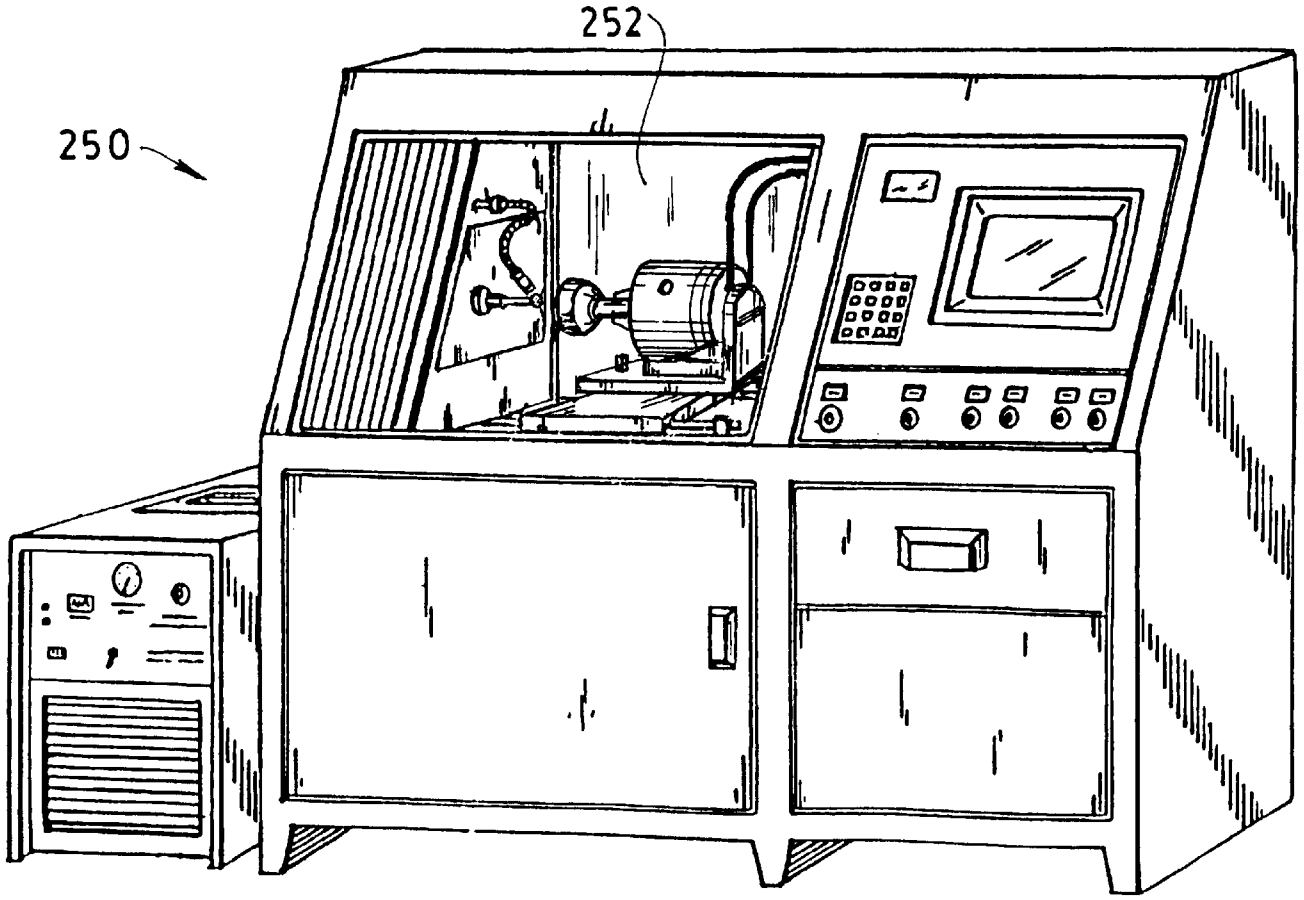
FIG. 37 is a front view of another preferred grinding machine of this invention.

FIG. 37 is a perspective view of a grinding machine 250 comprising a grinding apparatus 252.

Figure 38:
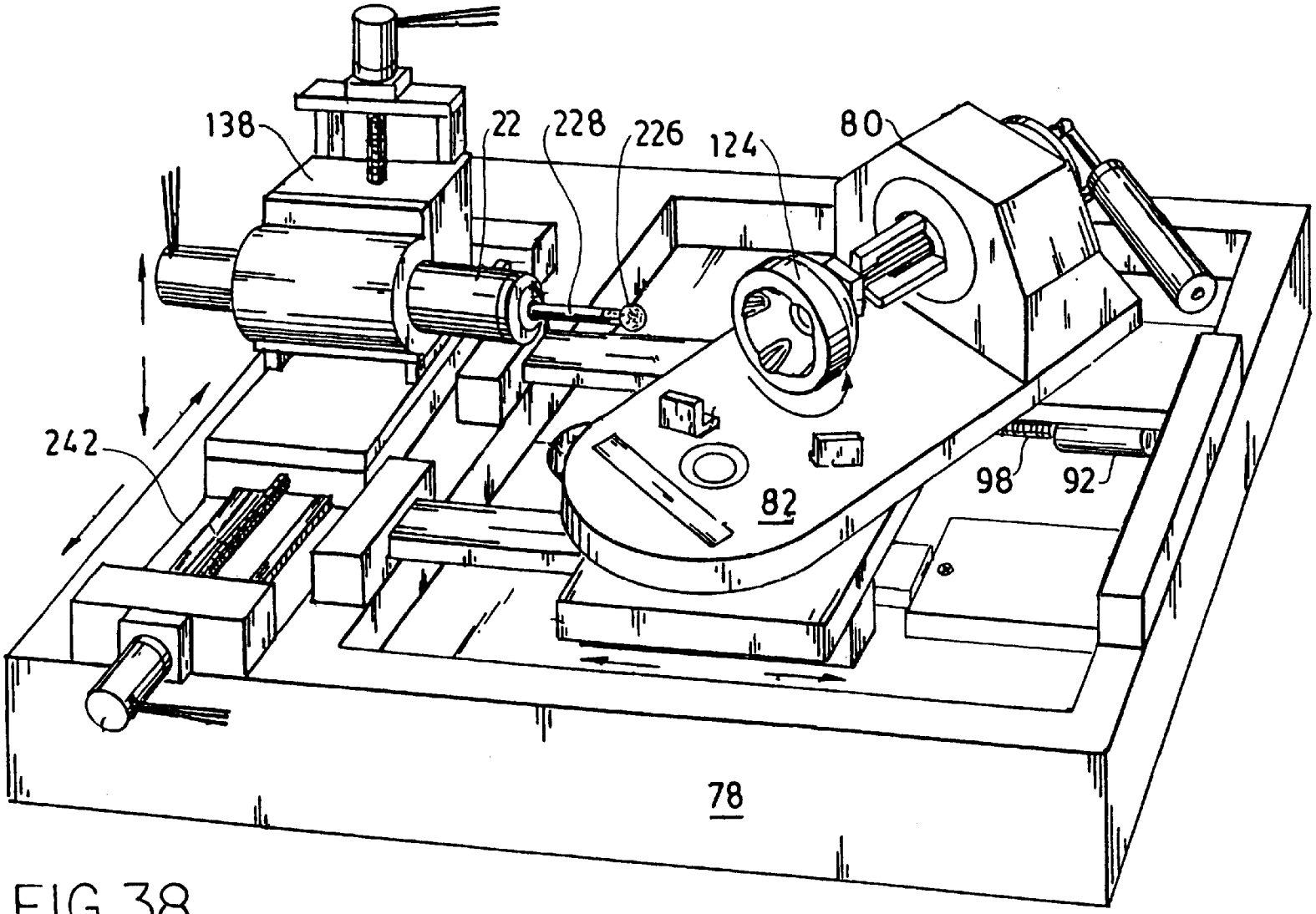
FIG. 38 is a top view of a portion of the grinding machine of FIG. 37.
Figure 39:
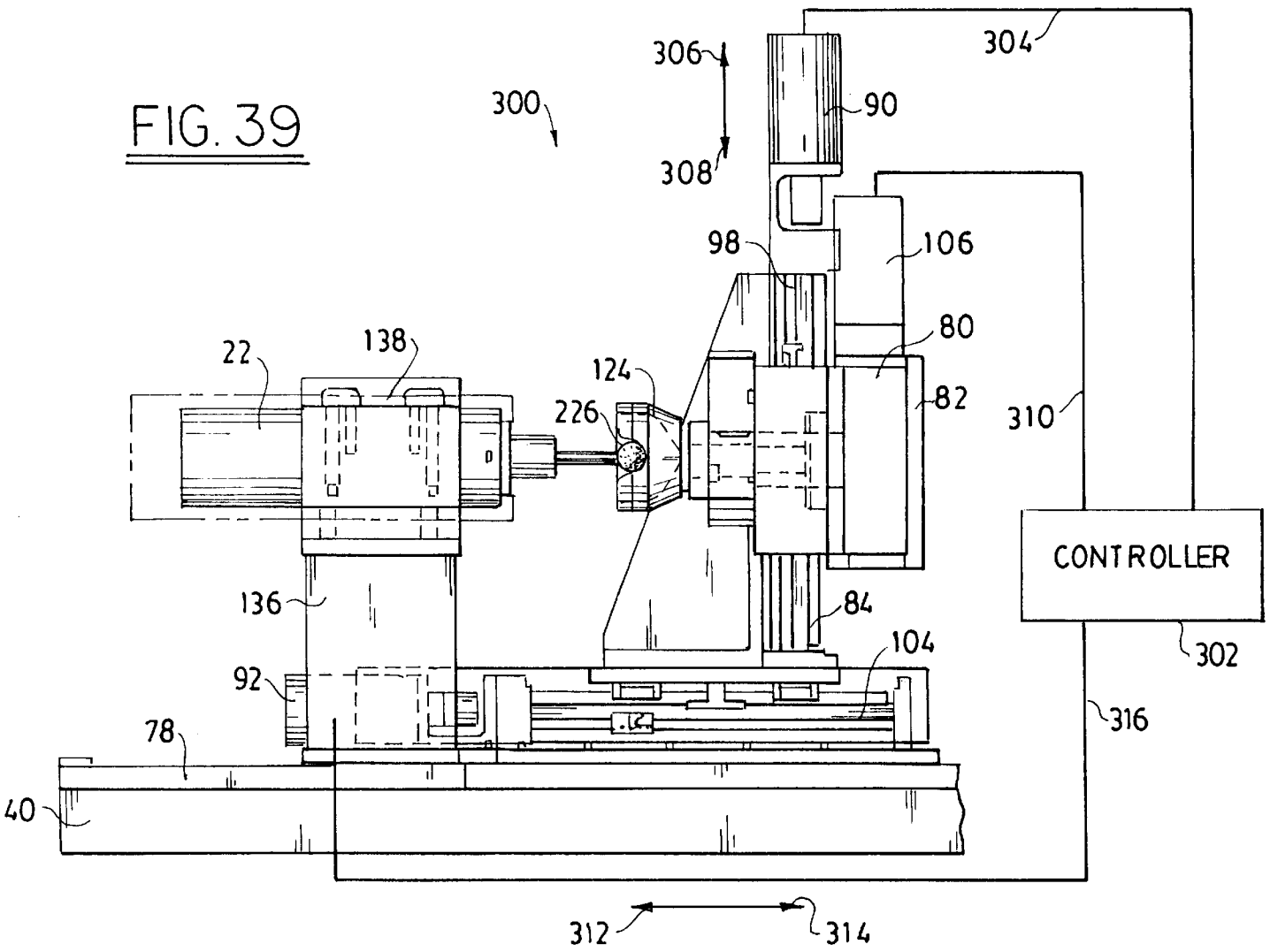
FIG. 39 is a schematic view of one preferred housing grinding machine of this invention.

FIG. 38 illustrates a preferred embodiment of grinding apparatus 252 which is comprised of YZ slide 242, spindle 22, tool bit 226 arbor 228, housing 124, rotary table 80, stepper motor 92, ball slide 98, base plate 78, bracket 82, spindle bracket 138. pos A Preferred Housing Grinding Machine of the Invention FIG. 39 is a schematic view of a preferred housing grinding machine which is similar in some respects to the machine depicted in FIG. 24.

Referring to FIG. 39, it will be seen that controller 302 is operatively connected to stepper motor 90 via line 304. Stepper motor 90, in turn, is connected to slide 98 and thus is capable of moving housing 124 in the Z axis in the directions of arrows 306 and 308.

A separate line from controller 302, line 310, is connected to stepper motor 106, which in turn, is connected to slide 98 which, in turn, is connected to slide 104. The housing is mounted on rotary table 80, which is mounted to Z axis slide 98; and the whole assembly can be moved in the X axis by stepper motor 92 in the directions of arrows 312 and 314. As will be seen from FIG. 39, stepper motor 92 is also operatively connected to controller 302 via line 316.

Referring again to FIG. 39, controller 302 also can cause housing 124 to rotate either clockwise or counter clockwise through its connection to stepper motor 106.

Controller 302 can simultaneously move housing 124 in both the X and Z axes. When this occurs, as is illustrated in FIG. 32, the resultant movement of the housing is a product of the two different movements.

Figures 40A, 40B, 40C, 40D, 40E:
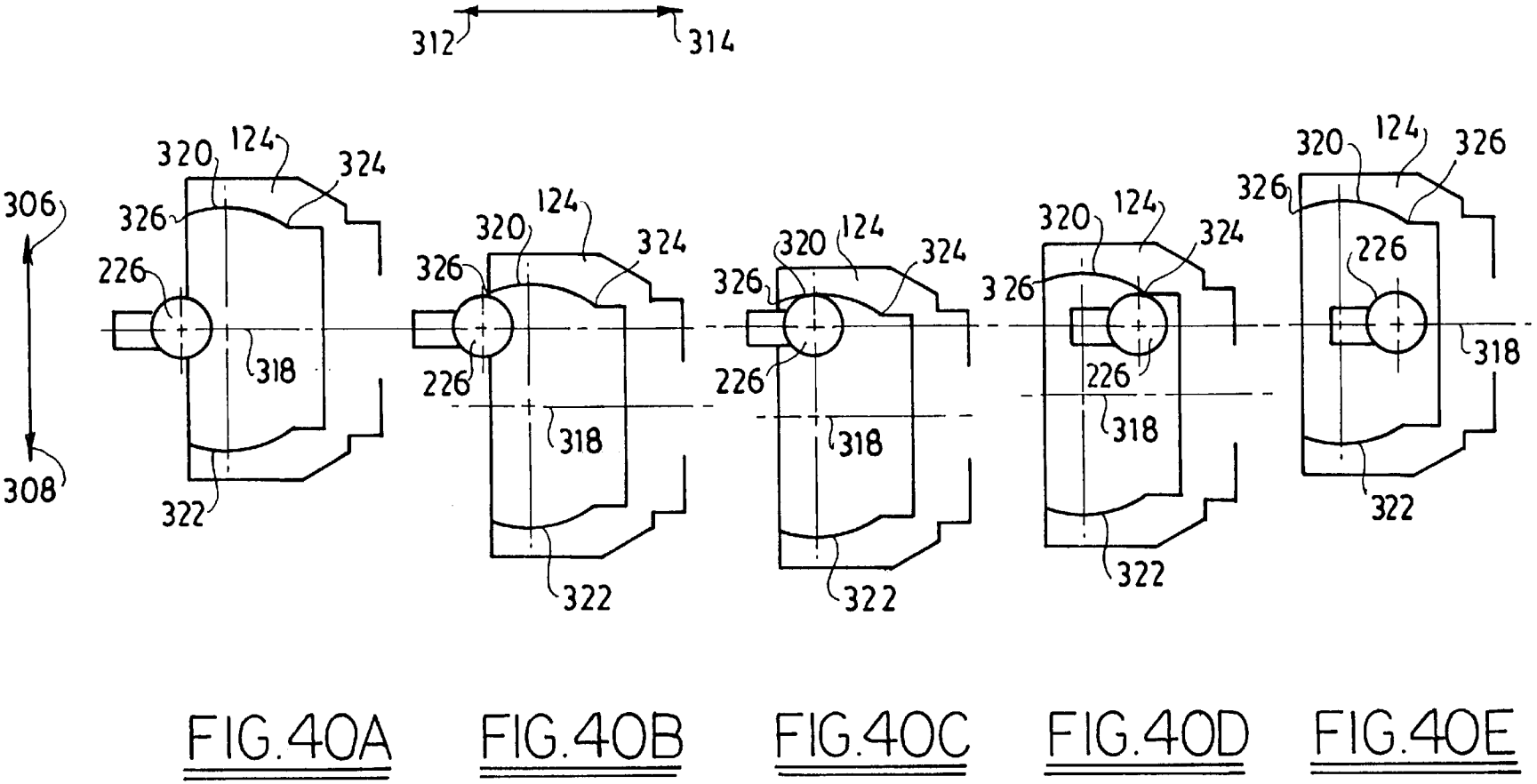
FIGS. 40A, 40B, 40C, 40D, 40E, 40F, 40G, 40H, and 40I illustrate the relative positions of a grinding bit and a housing at various portions of the cycle using the machine of FIG. 39.

Referring to FIG. 40A, and at the start of one cycle, grinding bit 226 is disposed substantially outside of the center 318 of housing 124. The sectional view of housing 124 depicts two opposed ball tracks 320 and 322. However, as will be apparent to those skilled in the art, such housings preferably have 6 such ball tracks, each disposed at about 60 degrees from the adjacent ball tracks.

Although the ball tracks 320 and 322 are depicted as having one arcuate portion 324, it will be understood that the ball tracks may be comprised of a linear portion (not shown), or of a combination of a linear portion and an arcuate portion.

Referring again to FIG. 40A, the grinding bit 226 is not positioned to grind ball track 320. Thus, housing 124 must be moved in the direction of arrow 308 in order to reach the starting position depicted in FIG. 40B.

Referring to FIG. 40B, the grinding bit 226 is impacting ball track 320 only at starting point 326. In order for it to grind the arcuate path necessary for ball track 320, housing 124 must simultaneously be moved in the directions of arrows 312 and either arrow 308 (when an ascending arcuate path is desired) or 306 (when a descending arcuate path is desired).

FIG. 40C illustrates the situation when housing 124 has been moved in the direction of arrows 312 and 308. FIG. 40D illustrates the situation when housing 124 has been moved in the directions of arrows 312 and 306.

Figures 40F, 40G, 40H, 40I:
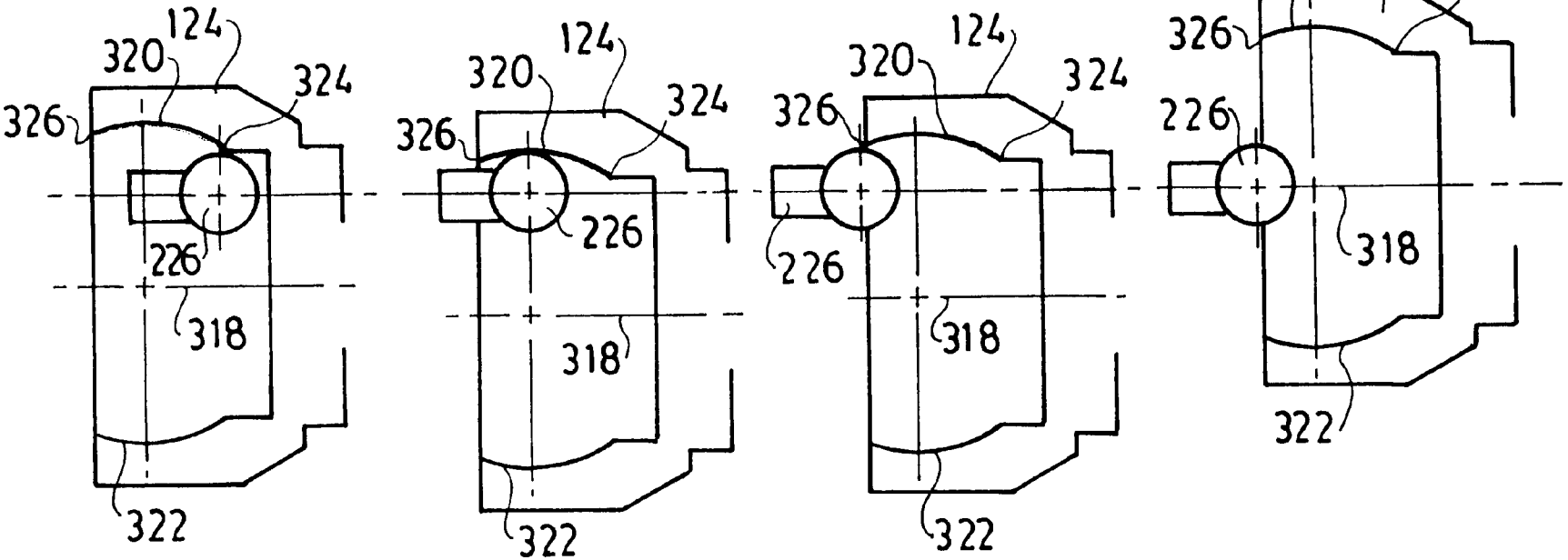

After track 320 has been ground, housing 124 may be moved in the direction of arrow 306 until the grinding bit 226 is substantially aligned with center line 318. Thereafter housing 124 may be rotated 60 degrees until a new unground track 321 is uppermost (see FIG. 40F). Thereafter, by moving housing 124 in the directions of arrows 308 (FIG. 40E), and/or 308 and 314 (see FIG. 40G), and/or 306 and 314 (see FIG. 40H), and 306 (see FIG. 40H), one may repeat the grinding cycle depicted in FIGS. 40A through 40E.

Thereafter, after the second track 321 has been ground, the housing may be rotated another 60 degrees and the repeated for a third track (not shown).

As will be apparent to those skilled in the art, the relative rates at which housing 124 is simultaneously moved in both the X and Z axes will dictate what type of compound movement is produced.

Figure 41:
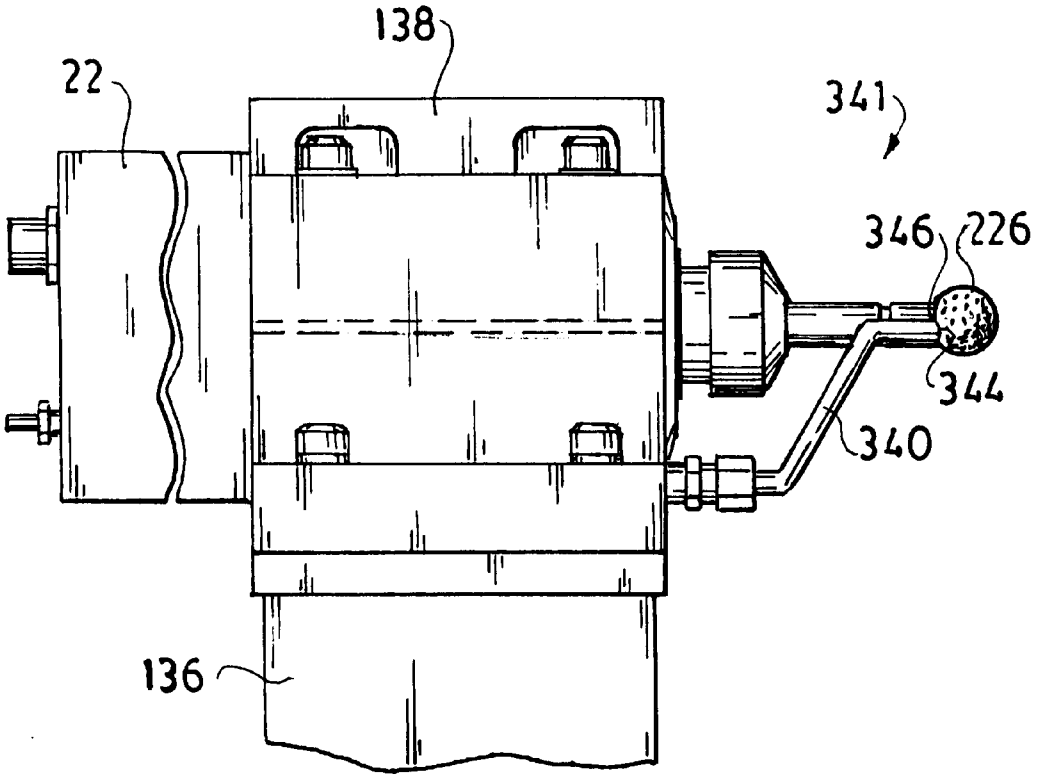
FIG. 41 is a schematic view of a preferred coolant injection system disposed vis a vis a tool bit.

FIG. 41 illustrates a preferred cooling system of this invention. Referring to FIG. 41, it will be seen that motorized high speed spindle 22 is mounted in spindle mount 136 with bracket 138. These parts are commercially available. Thus, by means of illustration, one may use as motorized spindle 22 a spindle identified as CVS-3920 by the Constant Velocity Systems Company of Clifton Park, N.Y. Similarly, one may use as spindle mount 136 and bracket 138 Constant Velocity's part CVS-0115.

Referring again to FIG. 41, it will be seen that secondary nozzle has an orifice 344 which directs fluid (not shown) at the perimeter 346 of tool bit 226.

Figure 42:
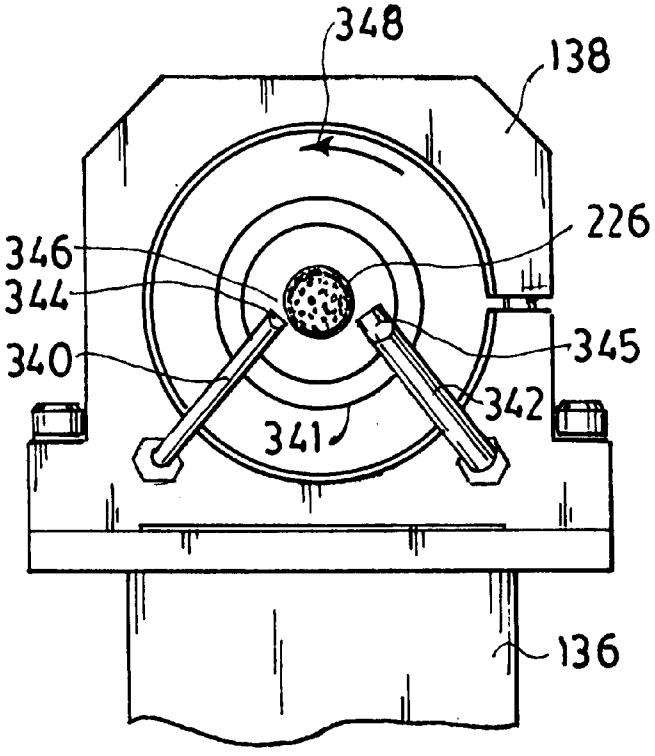
FIG. 42 is a front view of the coolant injection system of FIG. 41.

As will be seen from FIG. 42, the cooling system 341 also is comprised of a primary nozzle 342 with an orifice 345 which also directs fluid (not shown) towards the perimeter 346 of tool bit 226.

Figure 43:
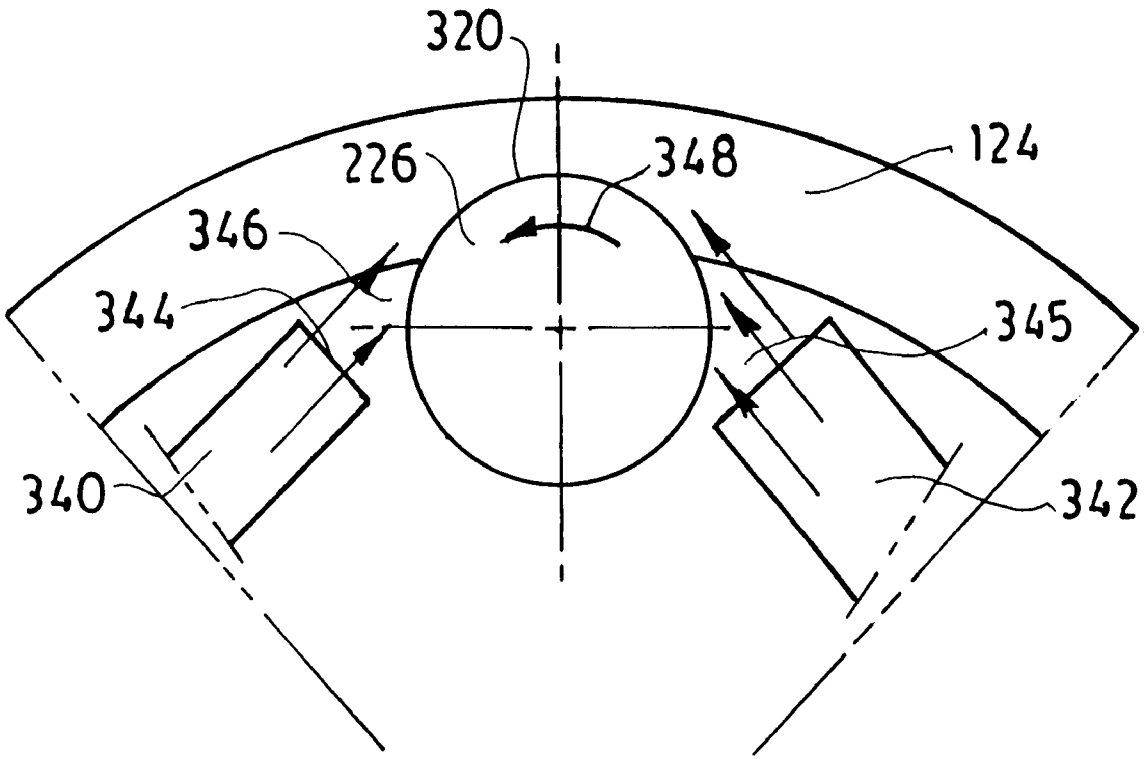
FIG. 43 is an enlarged front view of the coolant injection system of FIG. 41.

In the embodiment depicted in FIG. 42, the tool bit 226 is rotating in the direction of arrow 348. In this embodiment, fluid from primary nozzle 342 (not shown) flows in direction similar to the direction of rotation 348, whereas fluid from secondary nozzle 340 flows in a direction opposite to the direction of rotation 348. This is more clearly illustrated in FIG. 43.

In the preferred embodiment depicted in FIG. 42, secondary coolant nozzle 340 preferably has an outside diameter of about 0.25 inches, whereas primary coolant nozzle 342 preferably has an outside diameter of about 0.375 inches. It is preferred that the primary coolant nozzle 342 has a volumetric flow rate which is at least about 2 times as great as the volumetric flow rate of the secondary coolant nozzle 340.

One Preferred Inner Race Housing Grinding Machine

As will be apparent to those skilled in the art, the housing grinding machine illustrated in FIGS. 39 et seq. also may be used to grind inner races; see, e.g., FIG. 36.

Another Preferred Inner Race Grinding Machine

FIG. 44 is a sectional view of an inner race grinding machine 401 which is similar in many respects to the housing grinding machine 300 depicted in FIG. 39. The structure unique to machine 401 is described below.

Referring to FIG. 44, it will be seen that inner race grinding machine 401 is substantially similar to the housing grinding machine 300 depicted in FIG. 39 with the exception that the former machine is comprised of chuck 410, attaching chuck jaws 412, and a different spindle 414. Spindle 414 is mounted substantially perpendicularly to the plane of movement of the inner race 130, thus allowing grinding wheel 400 to access the ball grooves of the inner race 130.

Figure 44A:
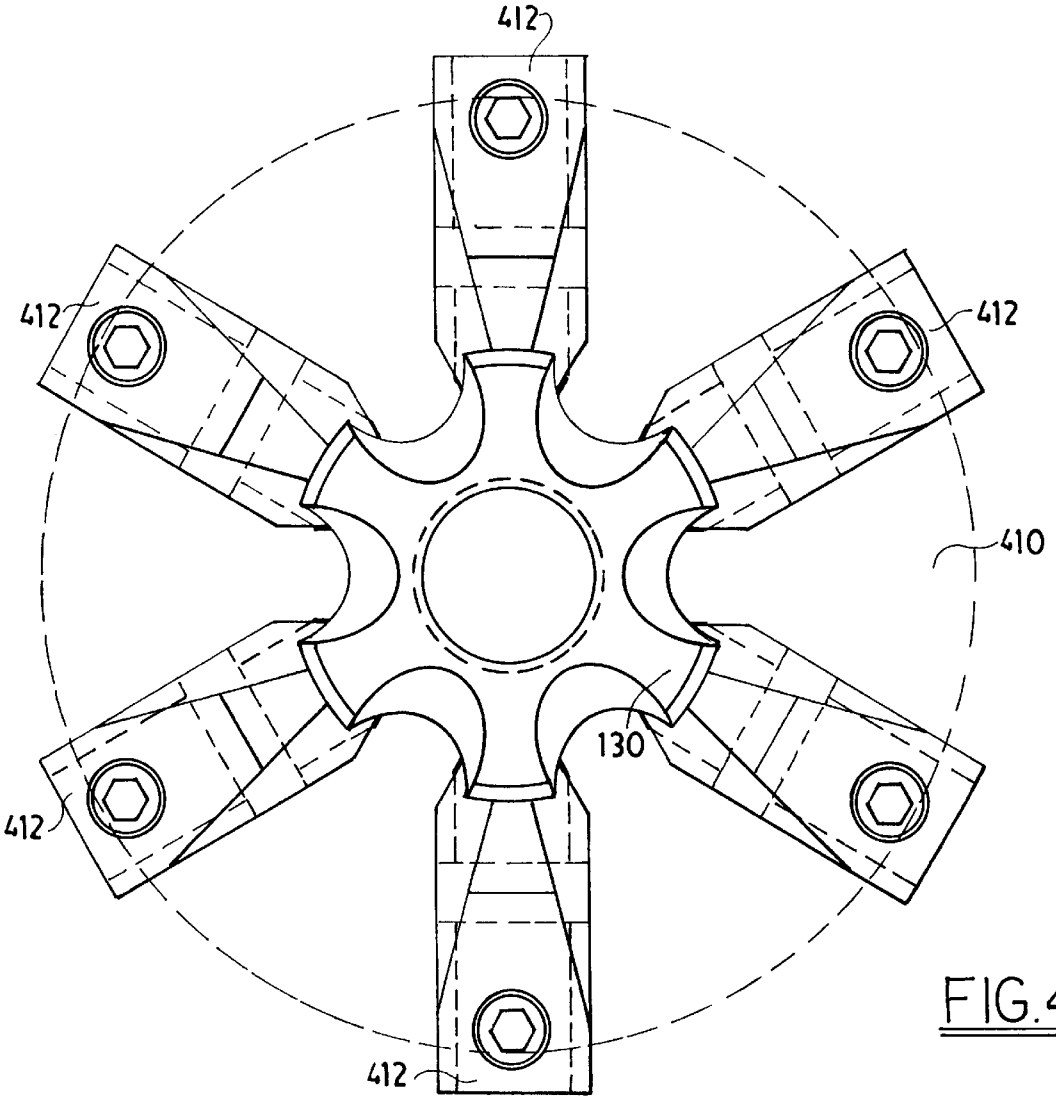
FIGS. 44A and 44B are front and side views, respectively, of the chuck used in the machine of FIG. 44.
Figure 44B:
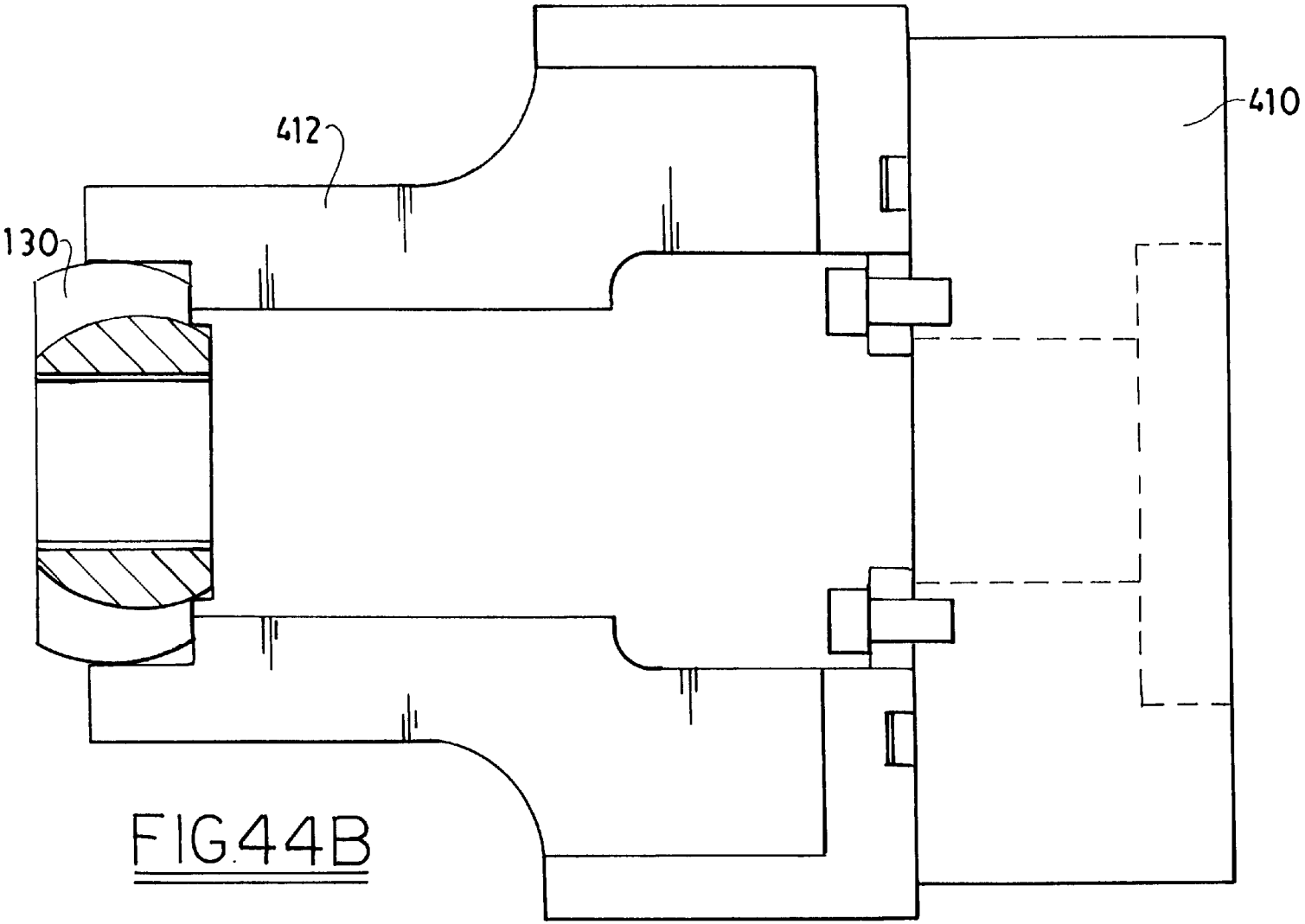

FIG. 44A is a front view of chuck 410, which is comprised of chuck jaws 412 and, disposed therein, inner race 130. FIG. 44B is a side view of chuck 410. As will be apparent to those skilled in the art, the configuration of chuck jaws 412 allows grinding wheel 400 to readily access the ball tracks of inner race 130.

Figures 45A, 45B, 45C, 45D, 45E, 45F, 45G, 45H, 45I:
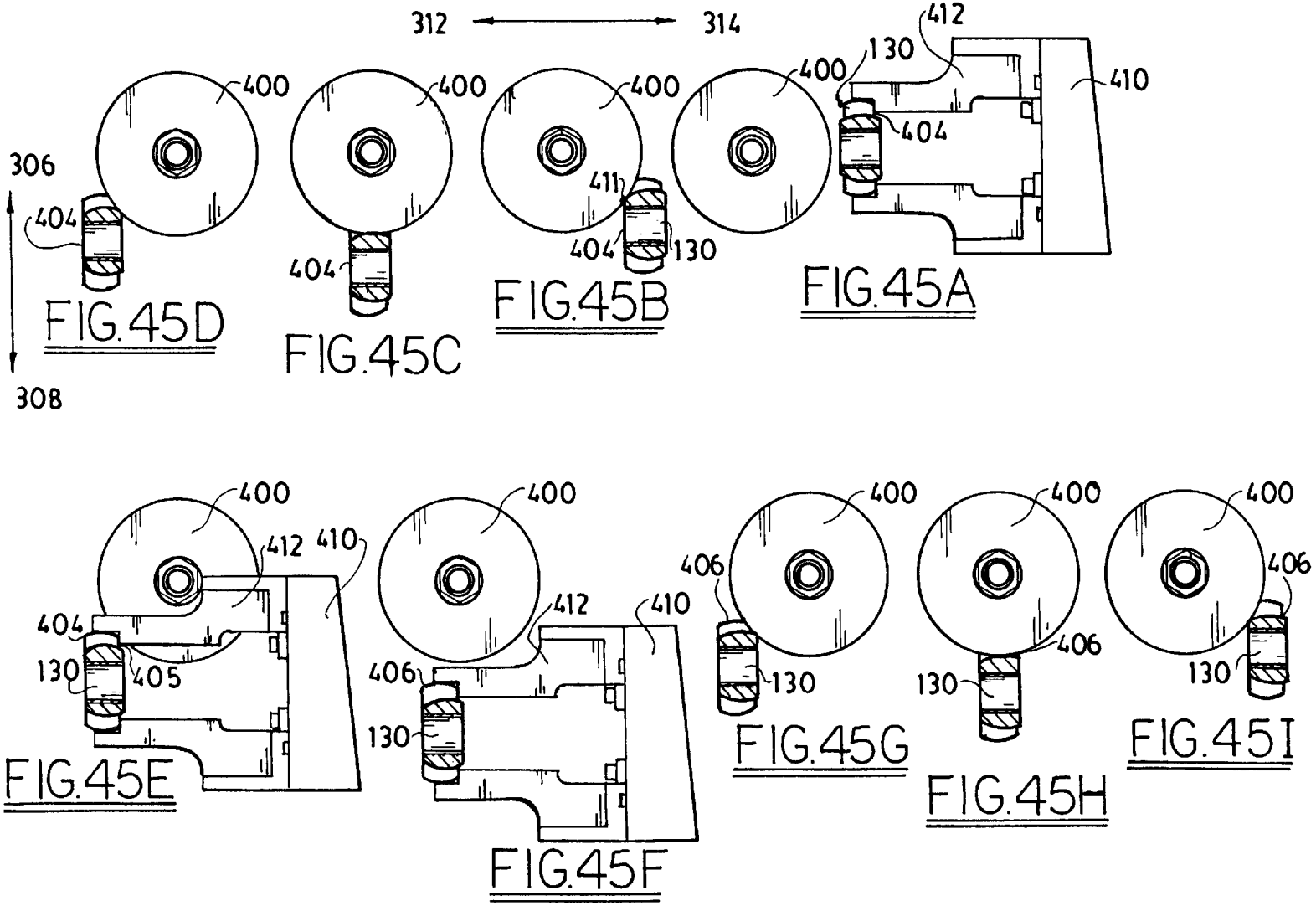
FIGS. 45A, 45B, 45C, 45D, 45E, 45F, 45G, 45H, and 45I illustrate the relative positions of a grinding wheel and an inner race at various portions of the cycle using the machine of FIG. 44.

Referring to FIG. 45A, and at the start of one cycle, grinding wheel 400 is disposed substantially outside of inner race 130. The sectional view of inner race 130 depicts two opposed ball tracks 404 and 406. However, as will be apparent to those skilled in the art, such inner races preferably have 6 such ball tracks, each disposed at about 60 degrees from the adjacent ball tracks.

Although the ball tracks 404 and 406 are depicted as having one arcuate portion, it will be understood that the ball tracks may be comprised of a linear portion (not shown), or of a combination of a linear portion and an arcuate portion (not shown).

FIGS. 45A through 45I illustrate the various positions grinding wheel 400 is in during the operation of grinding machine 401.

Referring to FIG. 45A, the grinding wheel 400 is not positioned to grind ball track 404. FIG. 45A shows grinding wheel 400, inner race 130 attached to chuck jaws 412 (which in turn are attached to chuck 410), prior to the grinding position. Thus, inner race 130 must be moved in the direction of arrows 308 and 312 in order to reach the starting position depicted in FIG. 45B.

Referring to FIG. 45B, the grinding wheel 400 is impacting ball track 404 only at starting point 411. In order for it to grind the arcuate path necessary for ball track 404, inner race 130 must simultaneously be moved in the directions of arrows 312 and either arrow 308 (when an ascending arcuate path is desired) or 306 (when a descending arcuate path is desired).

FIG. 45C illustrates the situation when inner race 130 has been moved in the direction of arrows 312 and 308. FIG. 45D illustrates the situation when inner race 130 has been moved in the directions of arrows 312 and 306.

After track 404 has been ground, FIG. 45E illustrates end position 405 of track 404, with the grinding wheel 400 clearing chuck jaws 412. Inner race 130 may be moved in the direction of arrow 308 and 314 until the grinding wheel 400 is clear of the inner race 130. Once, chuck jaws 412 clear grinding wheel 400, inner race 130 is rotated 60 degrees to new unground ball track 406. Thereafter unground track 406 of inner race 130 is then moved in the direction of arrows 306 and 314 to bring it into position to allow the grinding of unground track 406 (see FIG. 45G). Thereafter, by moving inner race 130 in the directions of arrows 306 (FIG. 45E), and/or 308 and 314 (see FIG. 45H), and/or 306 and 314 (see FIG. 45H), and 306 (see FIG. 45H), one may repeat the grinding cycle depicted in FIGS. 45A through 45E.

Thereafter, after the second track 406 has been ground (see FIG. 45I), the inner race may be rotated another 60 degrees and the grinding is repeated for a third track (not shown).

As will be apparent to those skilled in the art, the relative rates at which inner race 130 is simultaneously moved in both the X and Z axes will dictate what type of compound movement is produced.

Figure 46:
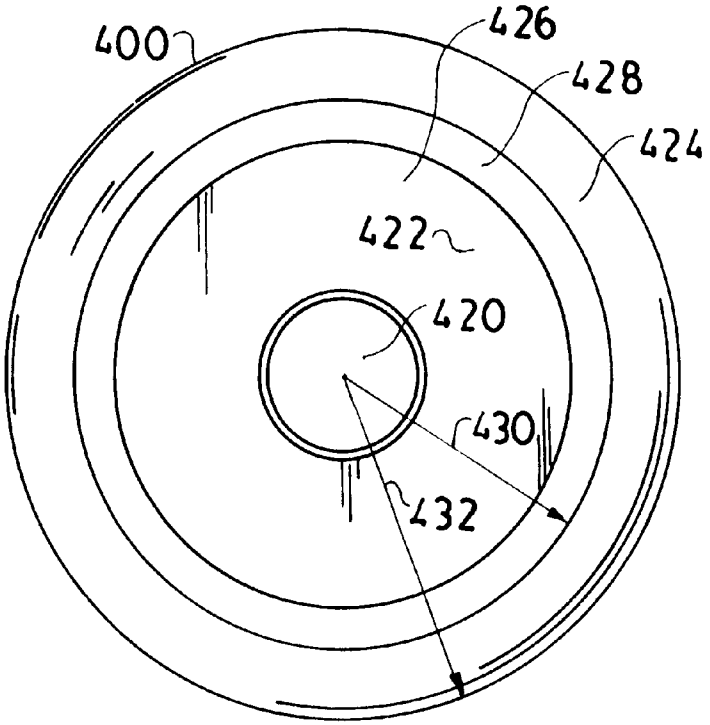
FIG. 46 is a side view of one preferred grinding wheel suitable for use in the machine of FIG. 44.

FIG. 46 is front view of a preferred grinding wheel 400 which may be used in the machine of FIG. 44. Referring to FIG. 46, it will be seen that grinding wheel 400 is comprised of bore 420 and a substrate 422. The substrate 422 is comprised of a coated peripheral coated section 424, and an uncoated interior section 426, and an intermediate, tapered section 428. As will be apparent to those skilled in the art, the coated peripheral section 424 has a substantially constant width (the difference between its inner diameter 430 and its outer diameter 432). In general, the constant width of coated peripheral section 424 is from about 0.25 to about 0.50 inches.

Referring to FIG. 46, it will be seen that intermediate tapered section 428 tapers inwardly from coated section 424 to uncoated section 426.

Figure 47:
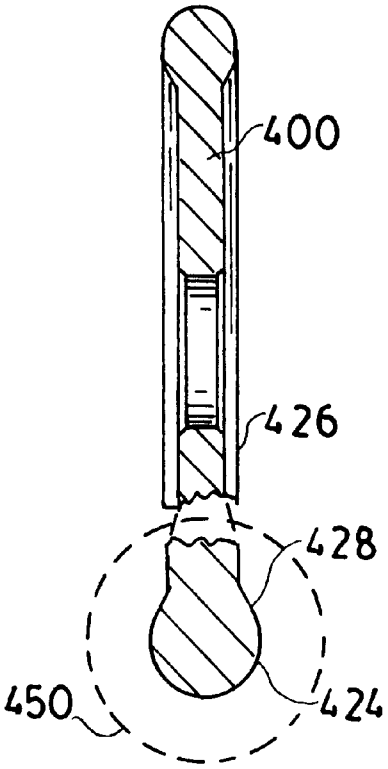
FIG. 47 is a partial sectional view of the grinding wheel of FIG. 46.

FIG. 47 is a side view of the grinding wheel 400 with section 450 enlarged to show the plated portion 424 and tapered portion 428 in more detail.

Figure 48:
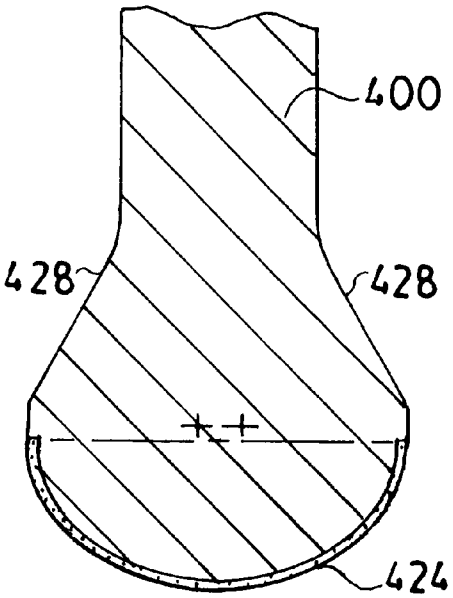
FIG. 48 is another partial sectional view of the grinding wheel of FIG. 46.

FIG. 48 is a partial sectional view of section 450 illustrating that, in the preferred embodiment depicted therein, the coated portion 424 of grinding wheel 400 preferably has a substantially elliptical shape.

The coated section 424 is substantially concentric with intermediate section 428, uncoated section 426, and bore 422.

The substrate 422 is preferably comprised of steel, and most preferably contains the same steel as is present in the grinding bit.

The cubic boron nitride abrasive coating may be applied in substantially the same manner described elsewhere in this specification.

In one preferred embodiment, the abrasive coating is applied in substantially the manner described in U.S. Pat. No. 5,492,771, the entire disclosure of which is hereby incorporated by reference into this specification. In this embodiment, the coating is a monolayer of superabrasive particles bonded to the substrate by a braze alloy bond composition comprising approximately a combined amount of silver and copper of at least 70 percent by weight, an amount of an active metal sufficient to cause such braze alloy to wet said superabrasive particles and substrate upon being heated to the alloy's melting point, said braze alloy being characterized by having an elastic modulus of at least 15,000,000 pounds per square inch, a ductility of at least about 10 percent of greater, and a yield strength of at least about 45,000 pounds per square inch.

Figure 49:
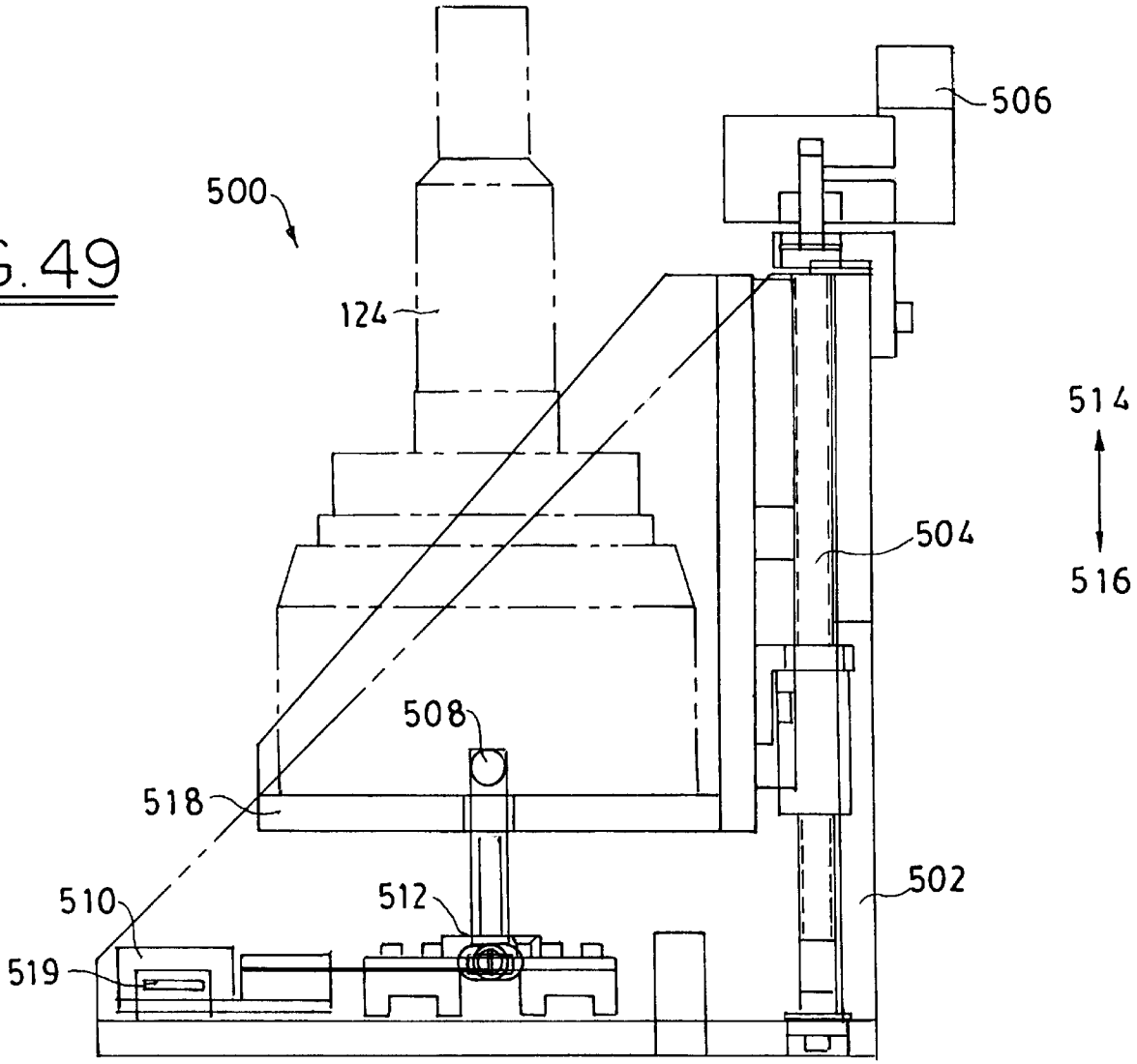
FIG. 49 is a front view of the measuring station of FIG. 48.

FIG. 49 is a side view of a housing measuring station 500 which comprises a base assembly 502, a slide assembly 504, a handle 506, measuring ball tips 508, measuring slide 510, and ball tip slide 512.

Figure 50:
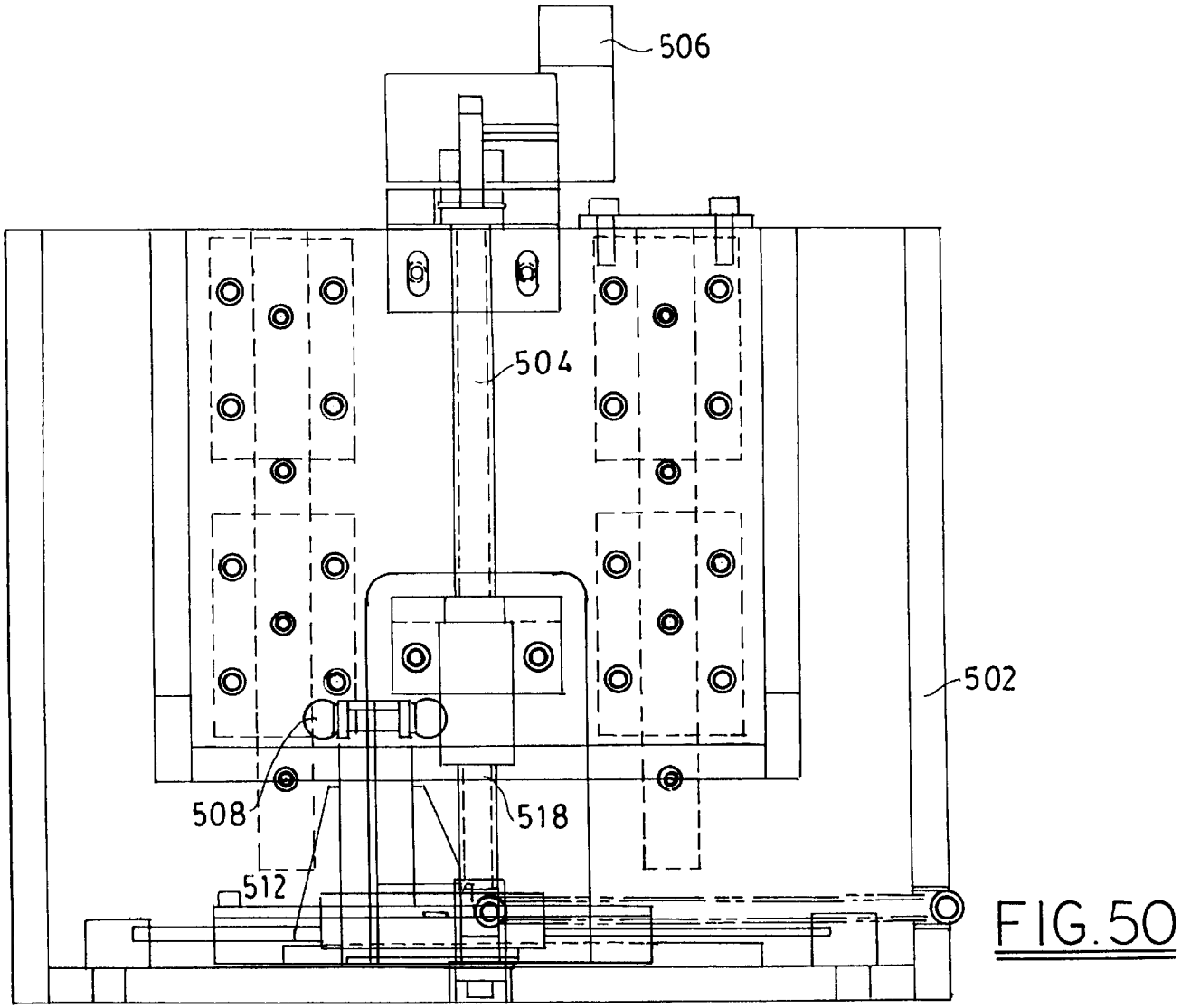
FIG. 50 is a top view of the measuring station of FIG. 48.
Figure 51:
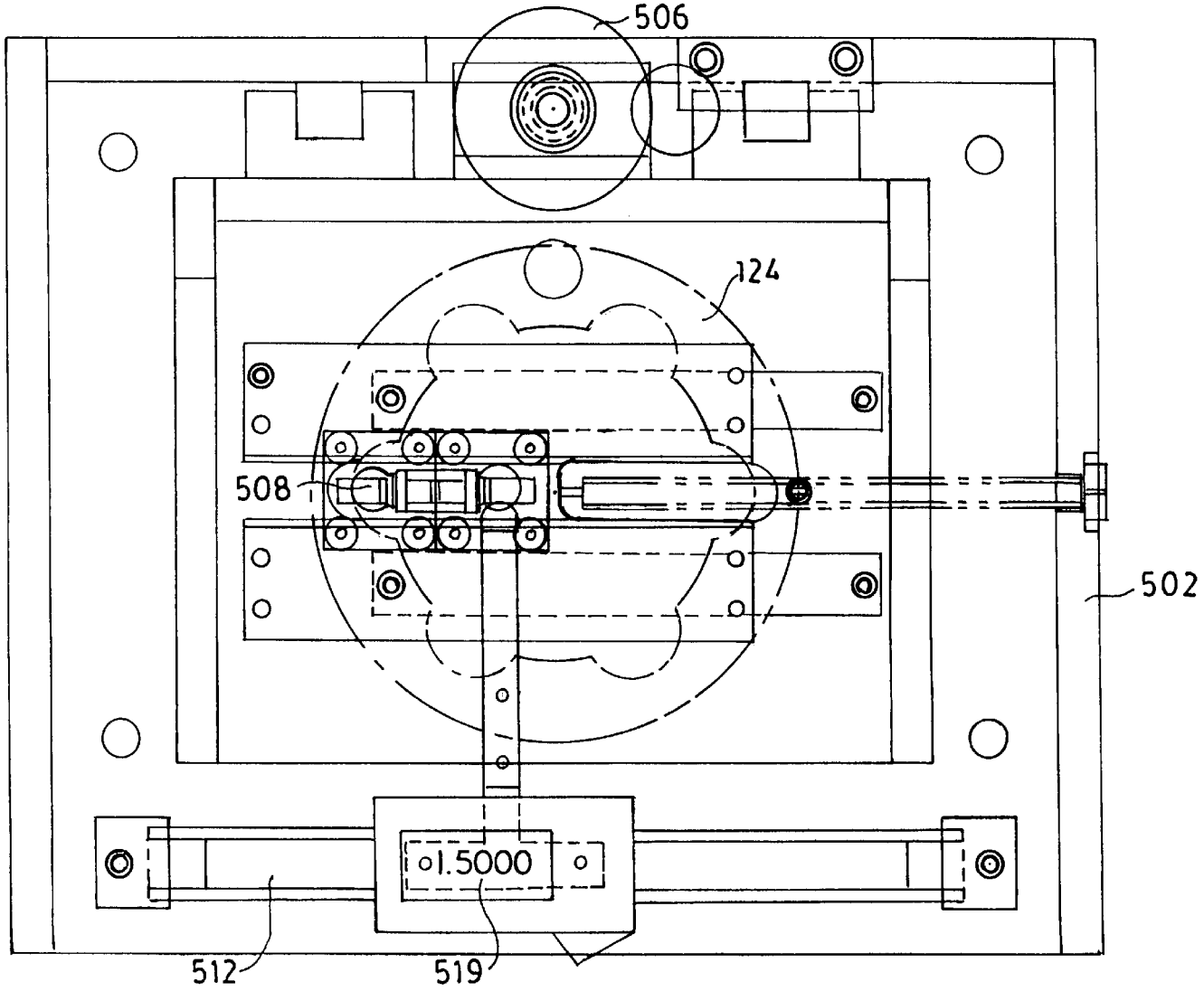
FIG. 51 is a side view of an inner race measuring station.

FIG. 50 is a front view of the housing measuring station of FIG. 49. FIG. 51 is a top view of the housing measuring station of FIG. 49.

Figure 52:
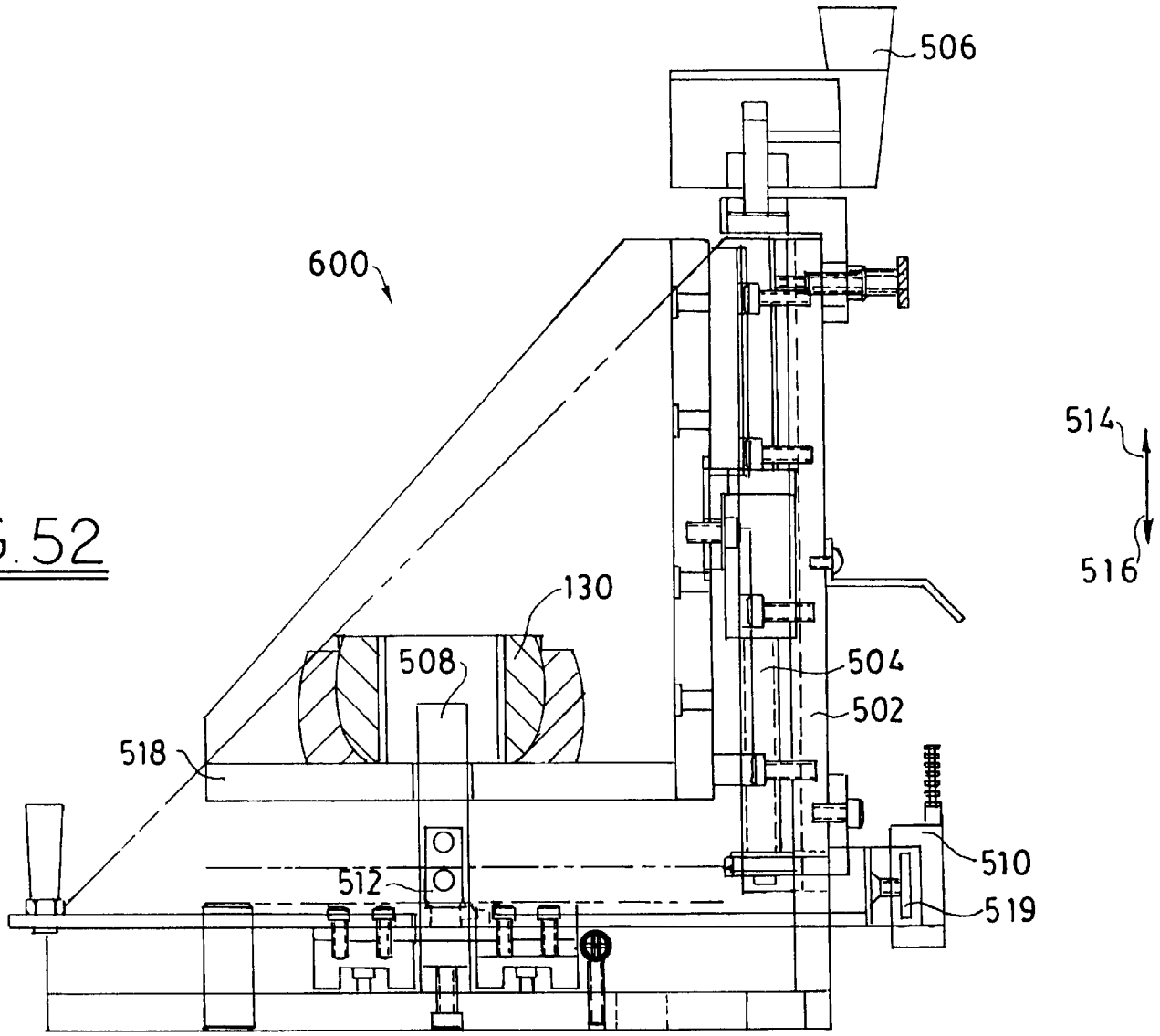
FIG. 52 is a side view of an inner race measuring station.
Figure 53:
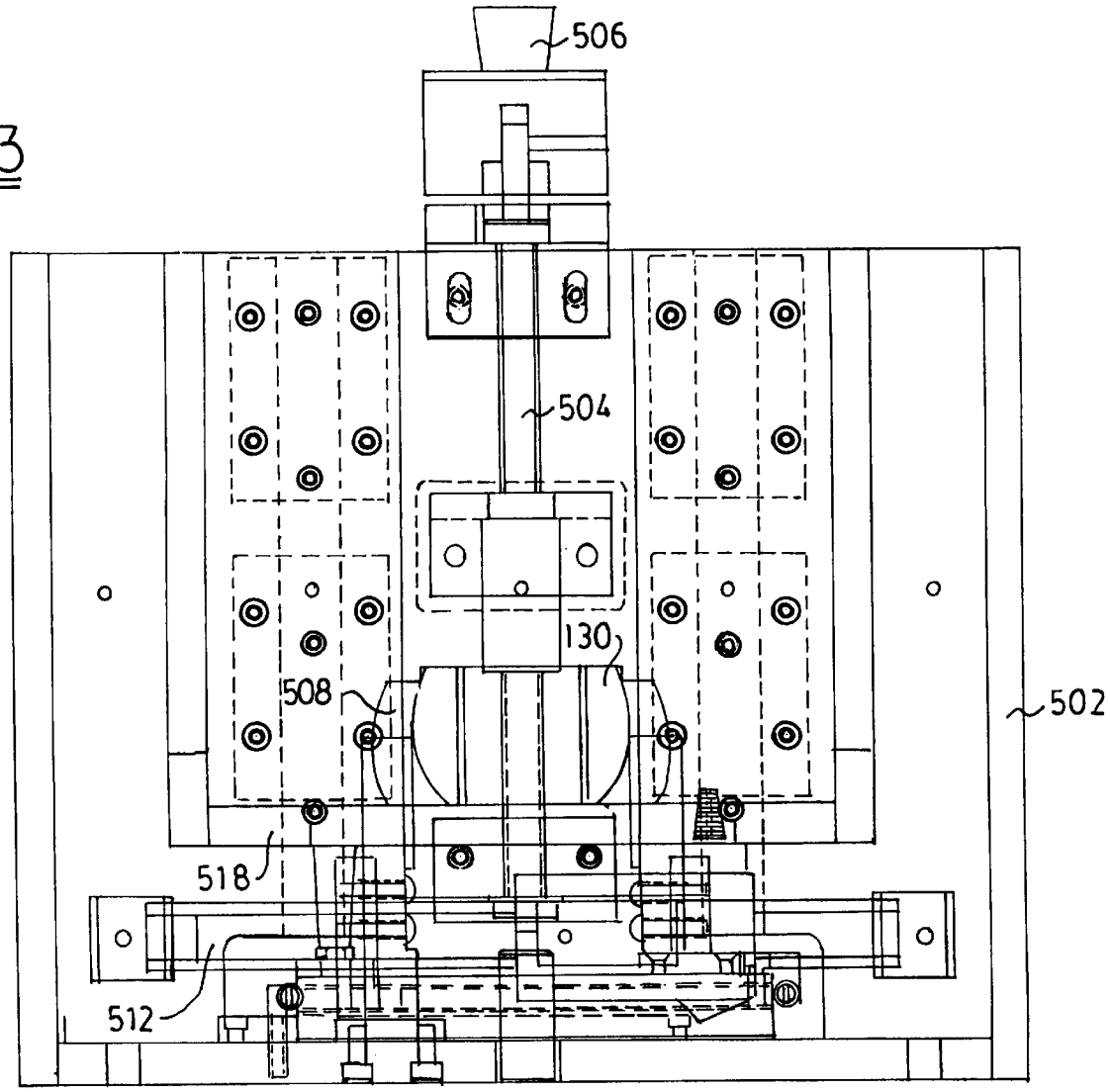
FIG. 53 is a front view of the inner race measuring station of FIG. 52.
Figure 54:
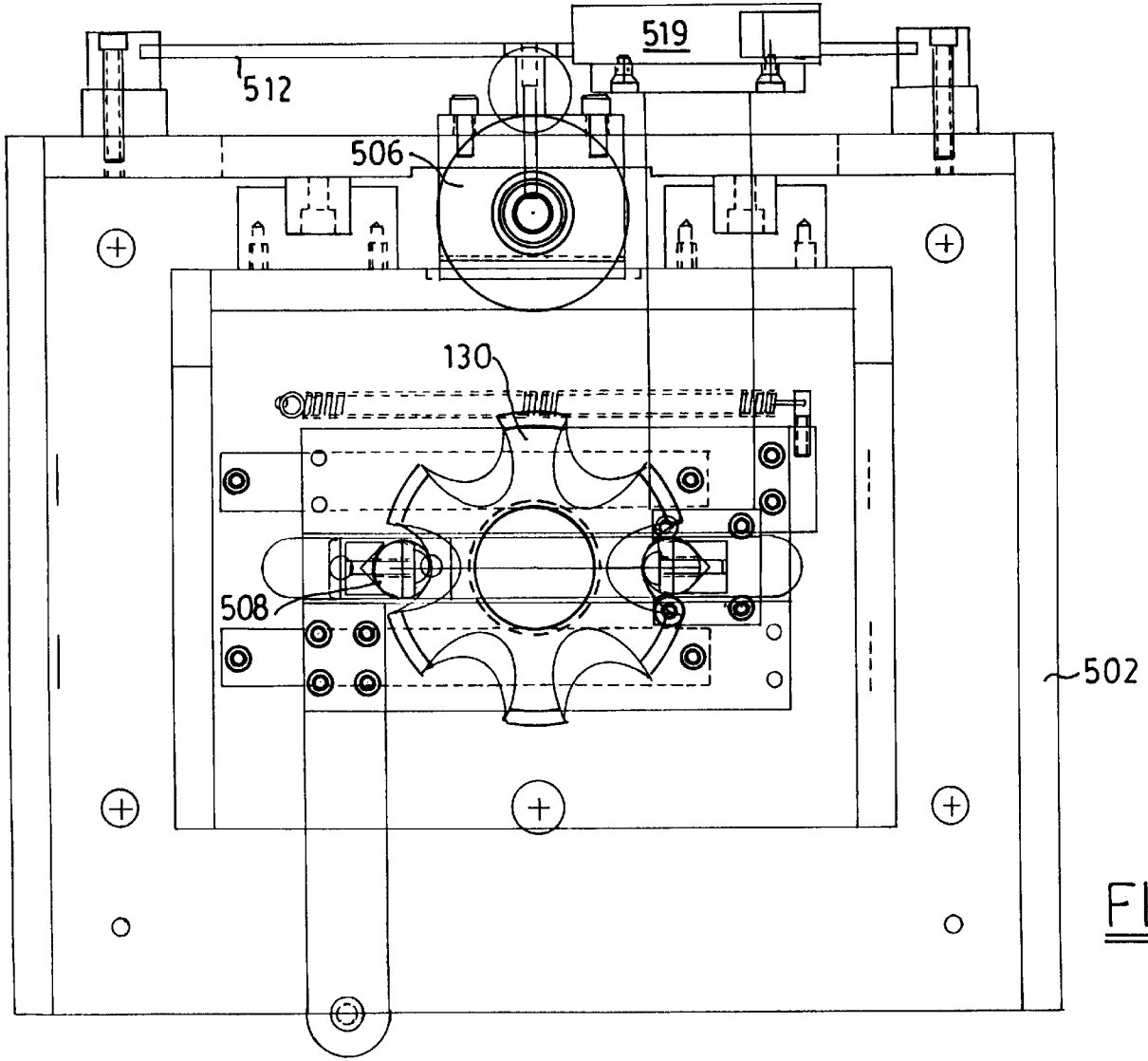
FIG. 54 is a top view of the inner race measuring station of FIG. 52.

As will be apparent to those skilled in the art, housing 124 may be placed on movable base 518 attached to slide 504. The housing 124 is movable in the directions depicted by arrows 514 or 516 by turning handle 506 clockwise or counter clockwise. The center plane of the housing 124 (not shown) is measured by balls 508 and displayed on display 519. FIG. 52 is a side view of an inner race measuring station 600. FIG. 53 is a front view of such inner race measuring station. FIG. 54 is a top view of such measuring station.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A grinding machine for regrinding an inner race of a constant velocity joint, comprising:

(a) a grinding wheel with a concentric outer grinding surface, wherein said grinding surface comprises boron nitride and consists essentially of a steel blank coated with cubic boron nitride;

(b) spindle means for rotating said grinding wheel in a first direction of rotation at a speed of at least about 5,000 revolutions per minute;

(c) a lubricating fluid injection system for lubricating said inner race and said grinding wheel, wherein:

1. said lubricating fluid injection system is comprised of a first coolant nozzle, a second coolant nozzle, means for directing a first flow of fluid from said first coolant nozzle to a first point on the perimeter of said grinding wheel, and means for directing a second flow of fluid from said second coolant nozzle to a second point on the perimeter of said grinding wheel, wherein said first point and said second point are substantially coplanar,
2. said first flow of fluid from said first coolant nozzle impinges said grinding wheel in the same direction as said first direction of rotation, and
3. said first coolant nozzle has a volumetric flow rate which is at least about 2 times as great as the volumetric flow rate of said second coolant nozzle;

(d) means for moving said inner race in the X axis, in the Z axis, and simultaneously in the X and Z axes; and (e) means for rotating said inner race.

2. The grinding machine as recited in claim 1, wherein said means for moving said inner race in the X axis comprises a first stepper motor and a first slide.

3. The grinding machine as recited in claim 2, wherein said means for moving said inner race in the Z axis comprises a second stepper motor and a second slide.

4. The grinding machine as recited in claim 1, wherein said grinding machine further comprises a base with a natural frequency of at least about 800 hertz.

5. The grinding machine as recited in claim 4, wherein said base has a torsional stiffness of at least about 50,000 foot-pounds per radian.

6. The grinding machine as recited in claim 4, wherein said base is comprised of structural members made from steel tubing comprised of interior chambers.

7. The grinding machine as recited in claim 6, wherein said interior chambers are filled with vibration reducing material.

8. The grinding machine as recited in claim 7, wherein said vibration reducing material is selected from the group consisting of sand and concrete.

9. The grinding machine as recited in claim 1, further comprising a spindle mount attached to said spindle means.

10. The grinding machine as recited in claim 9, wherein said spindle means is attached to a pedestal by means of said spindle mount.

11. The grinding machine as recited in claim 10, wherein said pedestal and said spindle mount consist essentially of steel.

* * * * *